United States Patent [19]

Wohlmuth

[11] 4,369,441

[45] Jan. 18, 1983

[54] DISPLAY CONTROL SYSTEM

[76] Inventor: Louis Wohlmuth, 1 Elm Hollow Ct., Baltimore, Md. 21208

[21] Appl. No.: 188,288

[22] Filed: Sep. 18, 1980

[51] Int. Cl.[3] ..... G09G 1/10

[52] U.S. Cl. ..... 340/733; 340/739

[58] Field of Search ..... 340/736, 738, 739, 742, 340/733

[56] References Cited

U.S. PATENT DOCUMENTS

| | | | |
|---|---|---|---|
| 3,483,547 | 12/1969 | Henderson | 340/738 |
| 3,611,346 | 10/1971 | Stoddard et al. | 340/738 |
| 3,675,230 | 7/1972 | Pitteway | 340/739 |
| 3,735,389 | 5/1973 | Tarczy-Hornoch | 340/739 |
| 3,746,912 | 7/1973 | Redecker et al. | 340/742 X |
| 4,001,806 | 1/1977 | Sweeting | 340/739 |
| 4,039,784 | 8/1977 | Quarton et al. | 340/733 X |

*Primary Examiner*—David L. Trafton

*Attorney, Agent, or Firm*—Cushman, Darby & Cushman

[57] ABSTRACT

A random refresh vector-generator type display system using a hybrid digital/analog vector generating technique. A digital vector generator decomposes medium length vectors into sub-vectors which are then drawn by an analog vector generator including a delay line. The system utilizes a long vector drawing technique wherein the first portion of a long vector is drawn at a first speed, the middle portion is drawn at a greater speed, and the final portion is drawn at the first speed. A feed forward circuit compensates for the sluggish response of deflection amplifiers of a display monitor so as to more precisely define beginning and end points of vectors. These amplifiers are further compensated by a delta theta circuit which temporarily freezes the system clock to allow the amplifier time to settle so that successive vectors will form sharp corners.

25 Claims, 20 Drawing Figures

DISPLAY CONTROL SYSTEM

TABLE OF CONTENTS

BACKGROUND OF THE INVENTION
SUMMARY OF THE INVENTION
BRIEF DESCRIPTION OF THE DRAWINGS
DETAILED DESCRIPTION OF THE PREFERRED EMBODIMENT
General Description
FIFO Memory
Command Format
Auxiliary Registers
Digital Vector Generator
Long Vector Operation
ALU Circuit
X+Y Digital To Analog Converters
Analog Vector Generator and Output Amplifier
Feed Forward Circuit
Grey Level Circuit
Delta-Theta Circuit
Video Circuit and Texture Generator
Summary of the Detailed Description
CLAIMS

BACKGROUND OF THE INVENTION

This invention relates generally to random refresh (as opposed to raster) display systems. More specifically, this invention relates to random refresh display systems that generate deflection signals from digital commands specifying vectors to be drawn on the display. Such display systems have application in architectural and engineering drawing, seismic waveform display, kinematics, simulation, and other display situations. Typically, an image being displayed comprises many discrete lines (vectors), interconnected in a variety of ways. Thus a set of vectors defines the image.

Cathode-ray tube (CRT) display monitors are well known for the graphic display of electrically computed or otherwise processed information. Basically, in a cathode-ray tube, a stream of electrons is directed from an electron gun past magnetic deflection coils or pairs of electrostatic deflection plates (depending upon whether the tube is a magnetic deflection or electrostatic deflection tube) towards a phosphorized screen. The point at which the electron beam formed by the stream of electrons impinges the screen is temporarily (except in applications wherein storage tubes are used) illuminated. Two pairs of deflection plates control the position of the resulting illuminated spot on the screen. The deflection of the illuminated spot from the center of the screen depends upon the magnitude of the current or voltage applied across the deflection coils or plates. One deflection coil or pair of deflection plates controls the deflection of the electron beam vertically in the Y-direction, and the other pair of plates controls the deflection horizontally in the X-direction. Simultaneously, the coils or pairs of plates can direct the electron beam to impinge on any point within the range of the screen, and predetermined voltage levels across the horizontal and vertical deflection coils or plates correspond to definite X- and Y-coordinate positions of the illuminated spot on the screen. The graphic display control system set forth in this patent generates the deflection signals (known in the art as the "X" and "Y" signals) and beam "on" or "off" signals (known in the art as the "video" signal) for driving such a display. In addition it generates a signal for controlling the brightness of each vector drawn (known in the art as the "Z" signal).

An image, defined by one or more vectors, persists on the face of the CRT for only a short period of time and is therefore "refreshed", usually at a rate of about 60 times/second, by redrawing the vectors defining the displayed image. An insufficiently frequent refresh results in apparent "flicker" of the displayed image. Also the brightness of a line is a function of its drawing speed. The faster a vector is drawn, the less bright it will appear. Thus a vector drawn at other than a constant speed will appear to have brightness changes along its length.

Generally, a digital data source, commonly computer-based although not necessarily so, provides vector information defining pictures to be drawn in the form of vector and display commands. These commands are processed by either a digital or an analog vector generator into the "X" and "Y" signals that are applied to the "X" and "Y" position inputs of the display monitor. These X and Y positional inputs couple the "X" and "Y" signals to display amplifiers which drive either a yoke containing magnetic deflection coils or pairs of electrostatic deflection plates to cause the displacement of a writing beam, from the cathode of the CRT, impinging upon the face of the tube. The present invention represents a novel technique for processing the digital commands from a digital data source into the "X" and "Y" positional signals brightness ("Z") signal and video signal suitable for driving a conventional display monitor.

The primary objective of all random refresh display systems, in general, is to display an accurate image representation of the vectors defined by the commands coupled thereto and to make the display as eye-pleasing as possible. More specifically, such systems attempt to display many picture lines with clearly defined and accurate beginning and end points, sharp corners, without screen "flicker", and with adjustment-free operation. These ideals have been difficult, if not impossible, to attain.

The prior art has developed along two separate and distinct lines. Systems of one such line of development utilize analog vector generators for generating the X and Y positional signals. Systems of the other line utilize digital vector generators to generate the X and Y positional signals.

The classic analog vector generator-type system uses an integrator to generate a "ramp" signal defining a smooth position change from a first to a second position; i.e. a first X coordinate to a second X coordinate and a first Y coordinate to a second Y coordinate.

An example of the classic integrator type vector generator is shown in U.S. Pat. No. 3,800,183-Halio et al (1974). There is an inherent inaccuracy in generating position signals with an integrator because small differences between the X and Y circuits cause a cumulative error in position and the drawn line does not pass through the desired end point. In fact, the longer the vector being drawn, the more pronounced this error becomes. Systems were devised for correcting this error. In such correcting systems difference between the actual position of the "dot" on a display tube and that called for by the vector command being executed is sensed. A correction signal is generated to bring the actual dot position into alignment with the called for position. In U.S. Pat. No. 3,800,183, a comparator circuit is used to sense the difference between actual and called for positions. Other systems, such as shown in U.S. Pat. No. 4,032,768-Rieger (1977) utilize complex feedback arrangements for correcting the cumulative error of analog type vector generators. Unfortunately, with such correcting systems complicated alignments are required in order to cause the X and Y deflections to reach their final destination at the same time.

Digital vector generators, on the other hand, are substantially adjustment free but may require expensive logic for implementation. One such example of a digital vector generator is shown in U.S. Pat. No. 3,723,802-Granberg et al (1973). Digital vector generators compute every point through which the beam must pass and therefore generally draw slower than analog vector generators. In addition, digital vector generators do not generate as smooth a picture line. Rather, the picture line drawn on the face of a monitor by digital vector generators is a staircase resulting from the stepwise jumps of X and Y position.

In both analog and digital vector generator systems, there has always been a tradeoff between the amount of picture information that can be accurately displayed and the flicker associated with the display by virtue of the continuous refreshing of the image formed on the display. As drawing speed is increased in order to minimize flicker by refreshing the displayed image more often, inaccuracies in the displayed image are accentuated, corners become less sharp and edges may not properly meet.

SUMMARY OF THE INVENTION

The primary objective of the present invention is to provide a vector generator-type random refresh display system overcoming or minimizing the disadvantages attendant with conventional analog and digital vector generators. The overall line drawing approach incorporates a hybrid digital/analog technique that provides a high quality image, drawing at a high rate of speed to avoid annoying flicker in a highly reliable and accurate system that is adjustment free. The technique utilizes a digital vector generator to accurately divide vectors defined by vector commands into a plurality of sub-vectors and then utilize a delay line analog vector generator to draw the shorter sub-vectors.

The drawing error in reaching the defined end point of a vector is minimized because error is proportional to the length of the vector drawn. The shorter sub-vectors drawn by the analog vector generator have no cumulative error and the dynamic error while drawing is significantly smaller than that obtained by conventional analog vector generators. The drawing rate of vectors drawn in this manner is relatively constant and independent of vector length. Since the digital generator computes sub-vectors and not each point along a line, inexpensive, lower cost circuits can be used to compute both in the digital vector generator and in the digital to analog converter. Furthermore, it is possible to compute both X and Y vector components serially using the same circuit, thereby providing additional cost reduction. The digital/analog hybrid vector drawing technique provides a drawing speed on the order of that obtainable with high quality analog vector generator systems while minimizing flicker.

In essence, the present invention provides an apparatus for generating, in response to a digital vector command, position signals for an electronically driven display comprising a digital vector generator for dividing the vectors defined by the vector command into sub-vectors; and an analog vector generator for generating position signals related to each of the sub-vectors.

Also provided is a method for drawing long vectors on an electronic display comprising the steps of: writing a first portion of the vector at a first constant speed; writing a second portion of the vector at a second constant speed greater than the first speed; and writing a third portion of the vector at a third constant speed less than the second constant speed.

BRIEF DESCRIPTION OF THE DRAWINGS

Many of the attendant advantages of the present invention will become apparent as the invention becomes better understood by reference to the following detailed description when considered in conjunction with the accompanying drawings, wherein.

DETAILED DESCRIPTION OF THE PREFERRED EMBODIMENT

General Description

Figure 1:
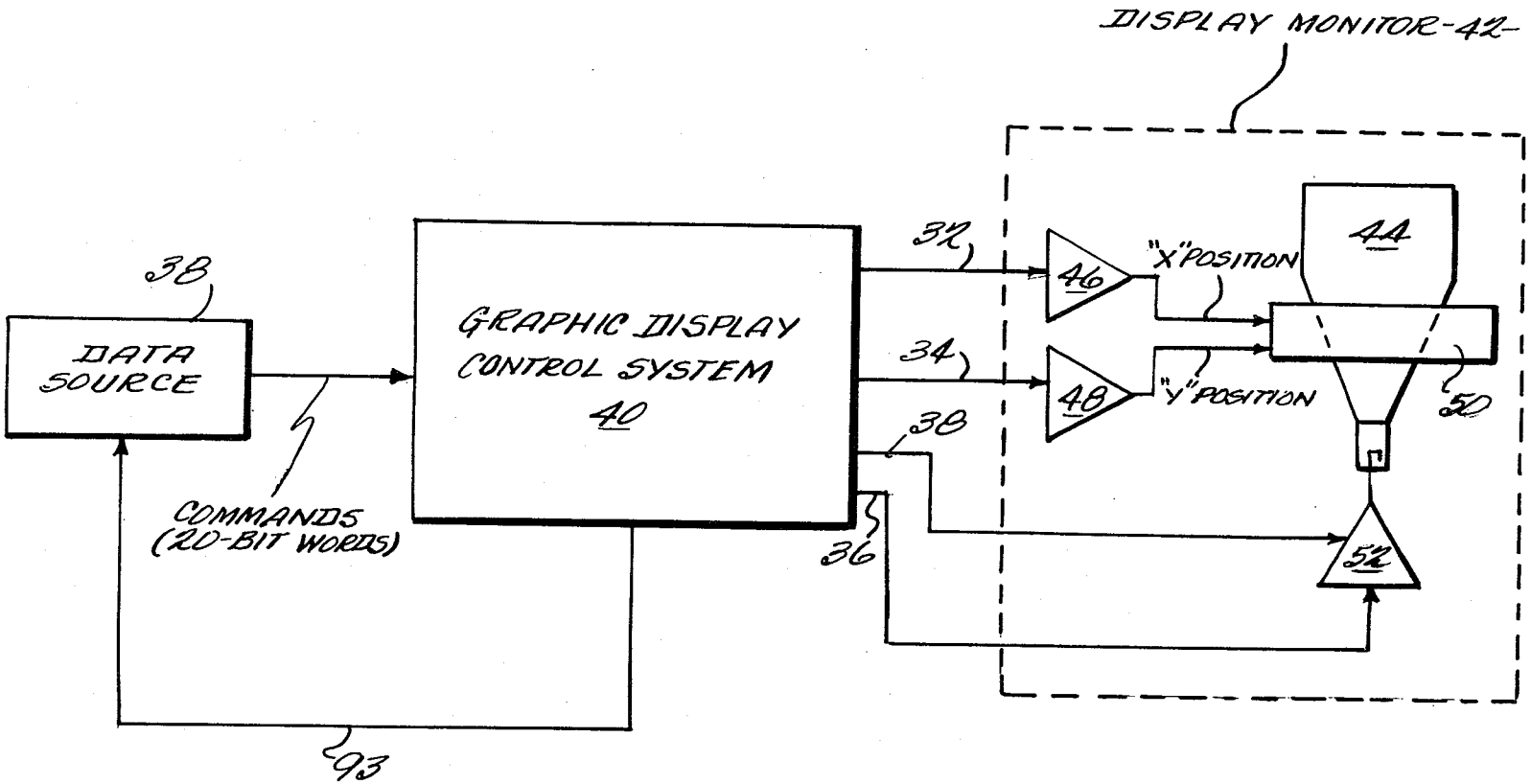
FIG. 1 is a block and pictorial diagram illustrating the manner in which the graphic display control system according to the present invention is used.

Referring now to FIG. 1 there is shown a block diagram illustrating the context in which the graphic display control system, designated generally by reference numeral 40 is used. Throughout the various block and schematic diagrams, in order to provide clarity, a single line or signal path may refer to multiple lines, i.e., a six (6) bit digital signal may be carried on six (6) lines. Such usage will be clear to those of ordinary skill in the art. Graphic display control system 40 operates on digital data commands from a data source 38 defining vectors and provides deflection signals to display monitor 42. These deflection signals generate an image on the face of a display monitor tube 44 of a display monitor 42.

More specifically, graphic display control system 40 provides analog signals on signal lines 32 and 34, respectively, for controlling the "X" and "Y" deflections of the beam of tube 44. An anlog signal provided on a line 36 known, in the art as the "Z" signal, controls brightness; and a digital "video" signal on a signal line 38 controls whether the beam of tube 44 is "on" or "off". In conventional display monitors, the "X" and "Y" signals are amplified respectively by "X" and "Y" amplifiers 46 and 48. The outputs of amplifiers 46 and 48 are coupled to a magnetic deflection yoke 50 (the use of a magnetic deflection tube is assumed) for deflecting the video beam emitted by the cathode of tube 44. The "Z" (brightness) signal, on line 36, along with the digital video signal on line 38 are coupled to a video amplifier 52 which controls the cathode of tube 44. A user of graphic display control system 40, by appropriate commands from data source 38 is able to:

1. Draw straight lines on the face of tube 44 by smoothly changing the X and Y positional outputs from a current position to a new one; i.e. draw vectors by updating the last X, Y beam position to a new X, Y beam position.
2. Absolutely position the beam of tube 44 (as opposed to moving relative to a previous position).
3. Load auxiliary registers (reference numeral 84 shown in FIG. 2) that modify the line drawing process by:
   a. controlling the brightness of the line.
   b. scaling the length of the line by an integer factor.
   c. controlling the speed with which a line is drawn on the face of tube 44.
   d. rotating or reflecting the direction of a drawn line in 90° increments.
   e. adding texture to the drawn line (dot, dash, etc.).
   f. selecting which of up to four display monitors 42 are to actively display the current information.
4. Generate artificial delays in the display process to enhance the picture formed on display monitor 42.
5. Cause the instantaneous X, Y position of the beam of tube 44 to be transferred back to data source 38 via a signal line 93.

In preforming the above specified functions graphic control display system 40 is able to draw smooth, straight, constant intensity lines on the face of tube 44.

Figure 2:
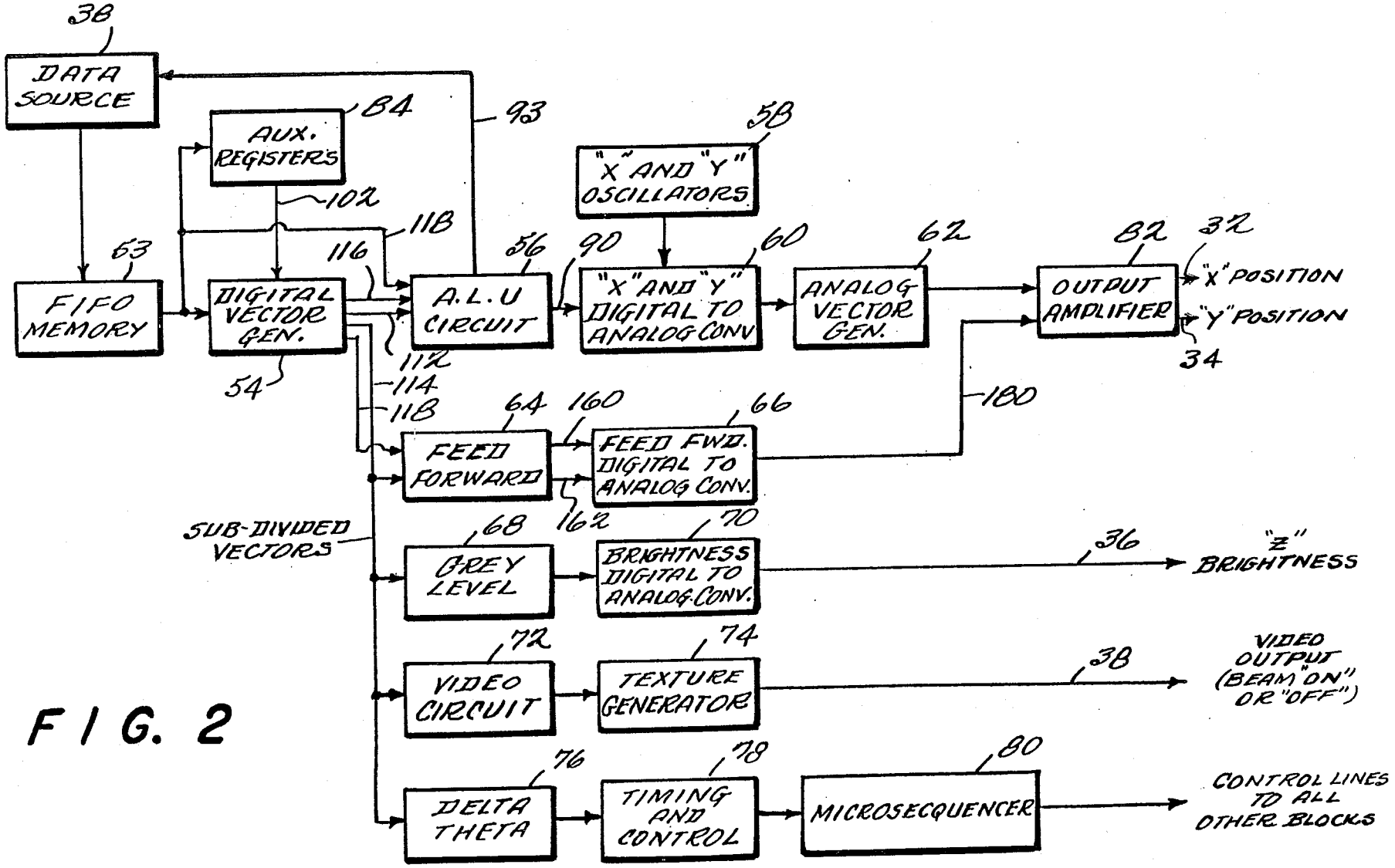
FIG. 2 is a more detailed block diagram of the graphic display control system according to the present invention.

Referring now to FIG. 2, there is shown a more detailed block diagram of graphic display control system 40 and its interconnections with data source 38 and display monitor 42. Vector commands and display commands, defining the vectors to be drawn on the face of tube 44, are provided by data source 38 and coupled to a first in first out (FIFO) memory 53. FIFO memory 53 acts as a timing buffer so that data source 38 and system 40 can operate asynchronously. Vector commands defining vectors of not longer than a predetermined length (63 units in this preferred embodiment) are coupled to a digital vector generator (DVG) 54 which may divide the vectors into shorter sub-vectors. Display commands are coupled from FIFO memory 53 to auxiliary registers 84 for controlling various display functions, such as texture (dot, dash, solid line) of a vector to be drawn, scale factors, brightness and the like.

The sub-vectors from DVG 54 are coupled to an arithmetic logic unit circuit (ALU circuit) 56 which includes "X" and "Y" registers for holding values corresponding to the current position of the beam of tube 44. An arithmetic logic unit (ALU) within ALU circuit 56 performs calculations which update the "X" and "Y" registers from a previous position value to a current position value in accordance with the sub-vectors presented to it from DVG 54. In other words ALU circuit 56 computes X current=X previous+X (defined by sub-vector)

Y current=Y previous+Y (defined by sub-vector)

Where X and Y are provided by DVG 54. The values of X and Y in the "X" and "Y" registers can also be set directly by a command coupled directly from FIFO memory 53 to ALU circuit 56 via a signal line 118. ALU circuit 56 can transmit vector labels back to data source 38 via a signal line 93 so that data source 38 can correlate its commands with an actual beam position. This enables interactive communication between a user and data source 38 if the data source is computer controlled. An example of such interaction is the use of a positional plotting electronic pen to move the video beam or hash mark to select from a "menu" displayed on the face of tube 44 by a computer acting as a data source 38 or to draw a new vector having a specific identity. Upon receiving a label on line 93, computer controlled data source 38 can go to an appropriate routine based upon the user selected menu item or execute a user instruction.

The X and Y positions calculated by ALU circuit 56 and stored within its "X" and "Y" registers are coupled to X and Y Digital to Analog Converts (DAC's) 60 which generate separate X and Y analog signals representing the vector defined by the subvectors generated by DVG 54. These analog signals are coupled to an analog vector generator (AVG) 62 which generates the smooth deflection signals necessary to draw smooth straight lines on the face of tube 44. The output of analog vector generator 62 is combined in an output amplifier 82 with a step voltage generated by a feed foward circuit 64 and feed forward DAC's 66. The purpose of step voltage is to compensate for the slow response of amplifiers 46 and 48 (see FIG. 1) in trying to change the magnetic energy in yoke 50. The combined signal from output amplifier 82 is transmitted to display monitor 42. X and Y oscillators 58 are provided to very slowly shift the picture on tube 44 to avoid the "burning in" of frequently displayed image lines.

A grey level circuit 68 and brightness DAC 70 provide the brightness (Z) analog signal to display monitor 42. These circuits provide compensation for any variations in drawing rates not eliminated by digital vector generator 54 and provides for any user specified variations in intensity. The video output signal (beam "on" and "off") is generated by a video circuit 72 and a texture generator 74 and includes the selection of one to four CRT's 38, line texture (dotted, dashed, etc.), and the suppression of video when vectors are drawn beyond the edge of tube 44.

A delta-theta circuit 76 improves the sharpness of corners formed by the meeting of two sub-vectors. Delta-theta circuit 76 analyzes the sub-vectors from digital vector generator 54 to detect corners between adjacent vectors as well as the start and stop points of a vector. This information is used by a timing and control circuit 78 to delay the initiation of the second of two successive vectors by temporarily freezing the system clock until amplifiers 46 and 48 (see FIG. 1) can settle. No delays are generated while the beam is off or between parallel or nearly parallel successive vectors. Finally, graphic display control system 40 includes a microsequencer 80 to control the flow of information through all of the other circuits thereof and assure that events take place in the proper sequence and at the proper time and in accordance with clock signals, as temporarily frozen by timing and control circuit 78.

FIFO Memory 53

Vector and display commands in the form of 20-bit words, provided by data source 38, are coupled to FIFO memory 53. FIFO memory 53 has a capacity of 64 words each word being 20 bits wide, and acts as a buffer between data source 38 and the signal processing portion of system 40. Display commands can be extracted from memory 53 under the control of microsequencer 80 at a rate different from the rate at which they are written therein. Thus, FIFO memory 53 acts as a timing interface or buffer between data source 38 and the rest of system 40. FIFO memory 53 holds a reservoir of data that can be drawn upon as needed. Thus data source 38 and system 40 may be operated asynchronously. The formats of vector and display commands from data source 38, temporarily stored in FIFO memory 53, are shown in FIG. 3.

Command Format

Figure 3:
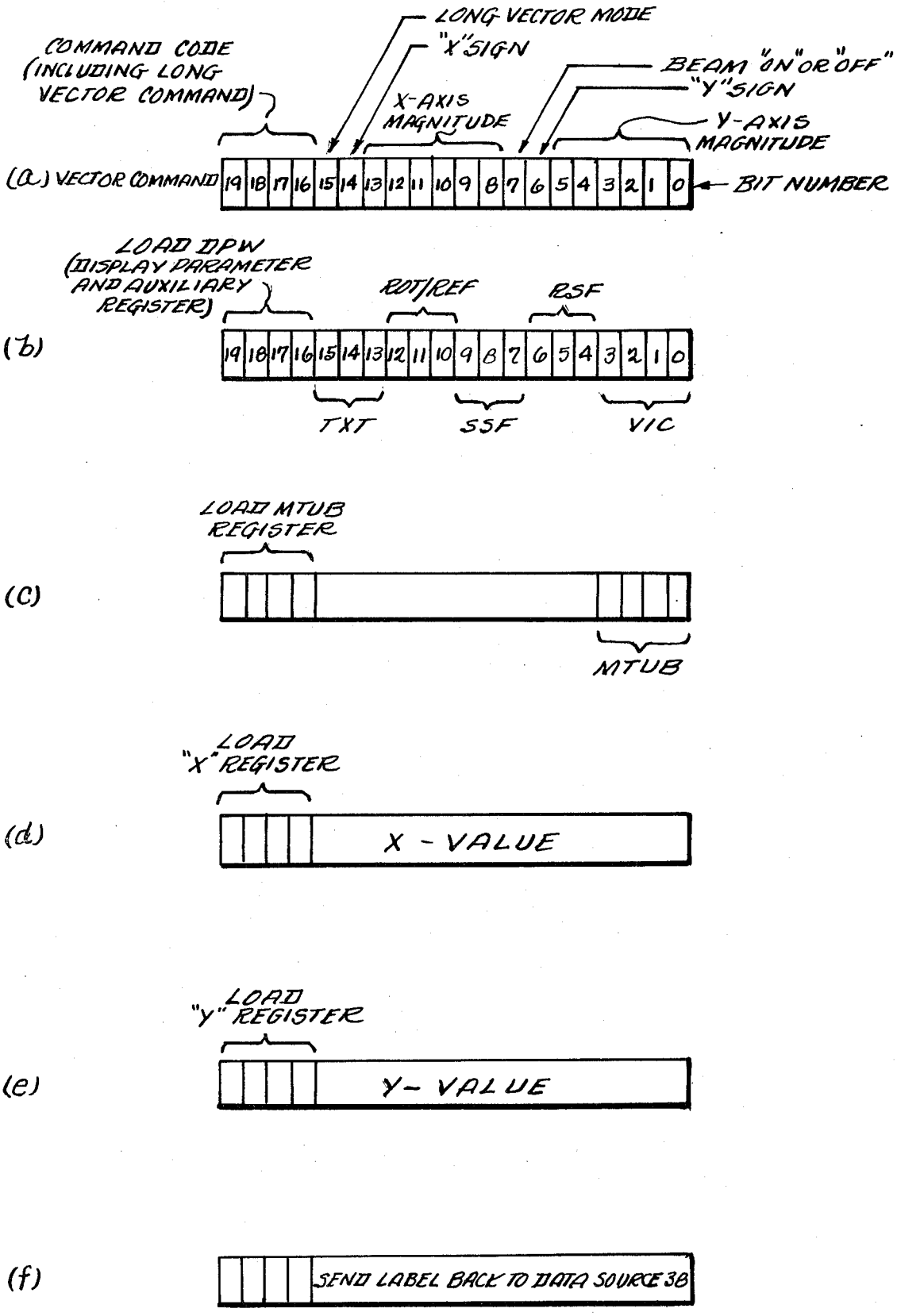
FIG. 3 is a series of five diagrams illustrating the formating of vector and display commands.

Referring now to FIG. 3, the formats of vector and display commands are shown. The format of a vector command, specifying a vector to be drawn on the face of tube 44 is shown in FIG. 3(*a*). The six (6) lowest order bits (0–5) contain a Y-axis magnitude indicating the amount of position change to occur (up or down) along the Y-axis. Bit 6 indicates the Y-sign, i.e. the direction of that positional change. Bit 7 indicates whether the beam of tube 44 is to be "on" or "off". (There are times when it is desirable to draw a blind vector with the beam off to get the beam to a new starting position on the tube without drawing a visible line on the tube). Bits 8–13 contain the X-axis magnitude information indicating the amount of positional change to occur along the X-axis. Bit 14 is the X-sign indicating the direction (right or left) of the X positional change. Bit 15 indicates whether system 40 is to operate in a "long vector mode" (to be further explained); and bits 16–19 contain a command code such as a "long vector command".

Various auxiliary commands are shown in FIG. 3(*b–f*). FIG. 3(*b*) illustrates a command for altering various display parameters. Bits 0–3 contain brightness information (variable intensity control - VIC). Bits 4–6 contain a repeat scale factor (RSF) indicating the number of times a vector is to be redrawn (repeated) consecutively at the same drawing rate. Bits 7–9 contain a step scale factor (SSF) which is a vector length multiplier that does not alter the drawing time for the vector thus increasing its drawing rate. Bits 10–12 call for a 90 rotation or a reflection (ROT/REF). Bits 13–15 identify the texture (TXT) (dot, dash, solid line, etc.) of the line to be drawn on the face of tube 44. Texture generator 74 ultimately translates this information into beam "on" and beam "off" signals. Bits 16–19 contain a command calling for the information in bits 0–15 to be loaded into a display parameter word register (DPW) within auxiliary registers 84. FIG. 3(*c*) illustrates a command for loading an MTUB (multiple tube) register. The data contained in bits 0–3 indicate which one of up to four (4) display monitors 42 are to be active and display the vectors drawn by system 40.

The commands shown in FIG. 3(*d*) and (*e*) illustrate how X and Y values can be absolutely set via line 118 (see FIG. 2), without sub-vector generation performed by a digital vector generator 54 or computation performed by ALU circuit 56. These commands would be coupled via a signal line 118 from FIFO memory 53 directly to X and Y registers of ALU circuit 56. Finally FIG. 3(*f*) illustrates a command calling for the transfer of a vector "label" back to data source 38 from system 40. Specifically such labels are transmitted from ALU circuit 56 to data source 38 via signal line 93. The commands shown in FIG. 3 are coupled either to digital vector generator 54, to auxiliary registers 84 or directly to ALU circuit 56 via line 118.

Auxiliary Registers 84

Figure 4:
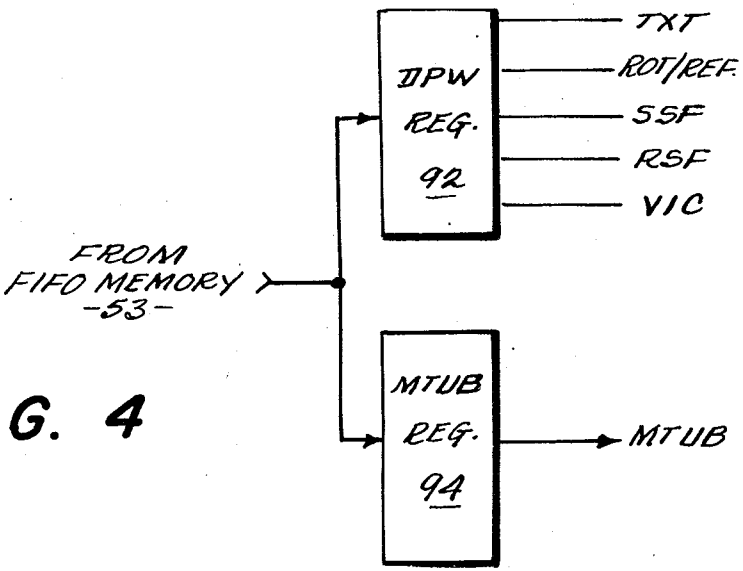
FIG. 4 is a more detailed block diagram of the auxiliary registers.
Figure 5:
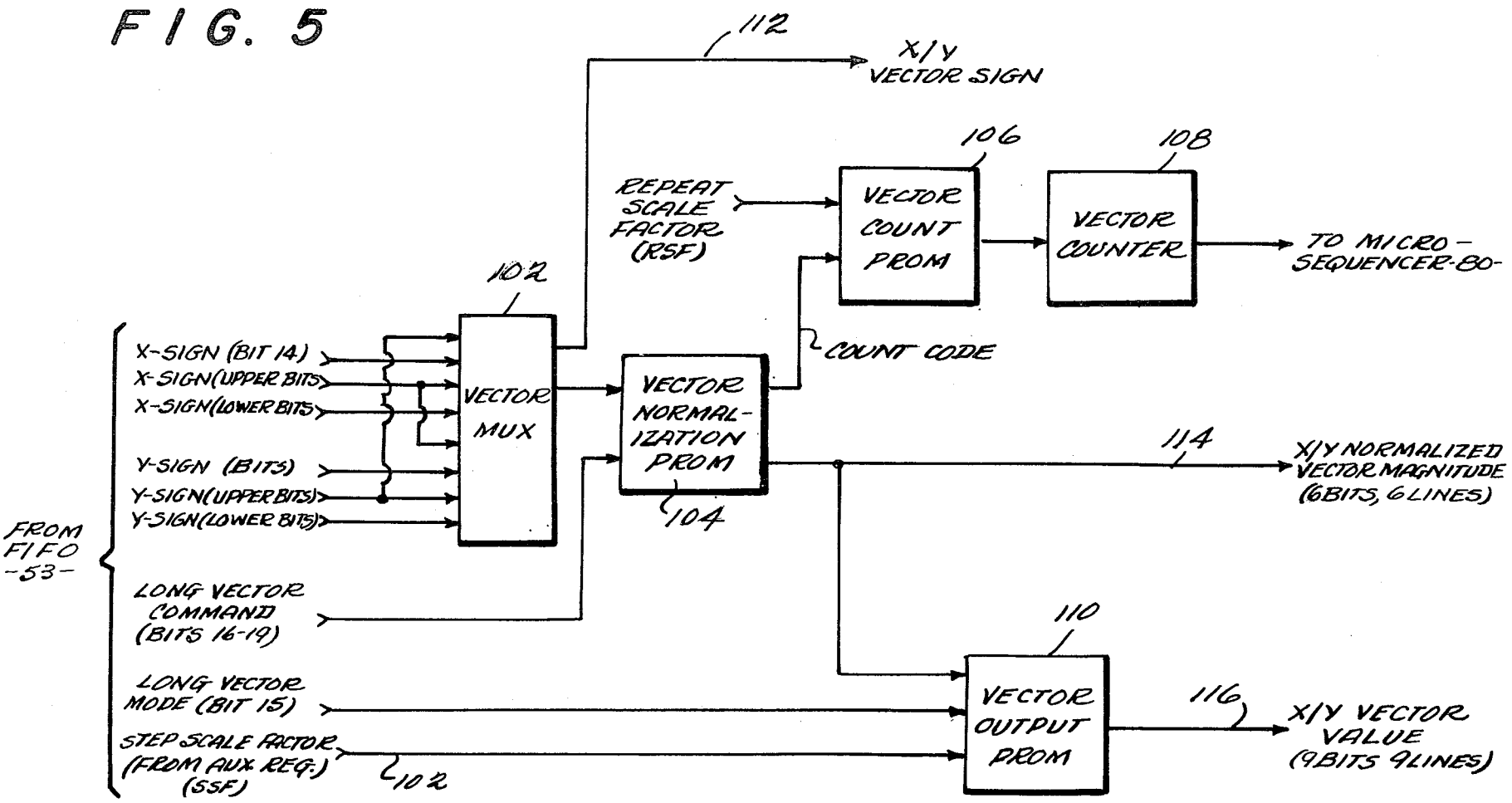
FIG. 5 is a more detailed block diagram of the digital vector generator.

Referring now to FIG. 4 there is shown a more detailed block diagram of Auxiliary Registers 84. Auxiliary registers 84 include a display parameter word (DPW) register 92 and a multiple tube register (MTUB) 94.

The contents of auxiliary rgisters 84 are directly controlled by display commands from FIFO memory 53. The following is a list of values contained within registers 84 and their use within the graphic display control system 40.

1. Multiple tube register 94 The values stored within multiple tube register 94 select which of four possible display monitors 42 are to actively display lines being drawn by system 40. The output signal line from this register actually selects one of four (4) display monitors 42 which can be coupled to system 40.
2. DPW Register 92
   a. The register values of VIC control the signal generated by grey level circuit 68 thereby controlling the brightness of vectors drawn on the face of tube 44.
   b. The register values of repeat scale factor (RSF) increase the length of a vector to be drawn without changing the drawing rate of speed. It does so by drawing the vector multiple times.
   c. The register values of step scale factor (SSF) increase the length of a vector by drawing a multiplied vector length in the period of time called for by the unmultiplied vector, thereby increasing drawing rate of the vector.
   d. The register values of the rotation/reflection control word (ROT/REF) change vector direction by reversing the X or Y sign or by interchanging the X and Y magnitude values.
   e. The register values of the texture control word (TXT) select one of eight possible textures by controlling Video Circuit 72 and texture generator 74.

Digital Vector Generator

As previously stated, considerable functional advantage is obtained by using a hybrid digital/analog form of vector generation. Vectors are digitally divided into sub-vectors which are each drawn by an analog vector generator, thereby minimizing the error associated with the analog drawing of a longer vector and causing the drawing rate to be relatively constant regardless of vector length. The sub-vector division is carried out by digital vector generator (DVG) 54.

DVG 54 receives vector commands from FIFO memory 53. These vector commands, in essence, call for the drawing of a vector up to 63 vector units (vector units are steps of a vector word), on the face of tube 44. In response to a vector command, such as illustrated in FIG. 3(*a*), DVG 54 generates a set of sub-vectors in screen units (for a particular display monitor 42, a screen unit may be 0.04 inch on the face of tube 44). DVG 54 normally divides each vector into 1, 2 or 4 sub-vector as follows:

| Vector length | # of Sub-vectors |
|---|---|
| 0–15 vector units | 1 |
| 16–31 vector units | 2 |
| 32–63 vector units | 4 |

The X and Y components of each vector are represented in sign-plus-magnitude format in the vector commands as shown in FIG. 3(*a*). Each component is processed serially. The generation of a single vector therefore takes two steps, one step for the X component and a second step for the Y component. A vector multiplexer (VECTOR MUX) selects between the X and Y component for each cycle. Not shown on the block diagram are the rotation reflection control bits from auxiliary registers 84 which can cause a reversal of the X sign or Y sign or the exchange of the X and Y components. The vector components are "normalized" by a vector normalization programmable read only memory (PROM) 104. A decision is made via a formula prestored in PROM 104 as to how many steps are to be used to draw a requested vector. In order to make this decision PROM 104 is presented with the magnitude of the current vector component and also the high order bits of the other component. The prestored information in PROM 104 provides a count code indicating the number of steps to be taken in drawing the vector. This count code is coupled to a vector count PROM 106 which takes into account the number of steps called for by vector normalization PROM 104 and the repeat scale factor (3 bits) from DPW Register 92 within Auxiliary Registers 84 (see FIG. 4) and provides an appropriate count setting signal to a vector counter 108. PROM 104 also provides a X/Y normalized vector magnitude on a signal line 114. This number is the fractional value to be added to the X/Y position at each step exclusive of scaling factors (such as RSF) determined by the vector drawing mode. The final X/Y vector value in screen units is determined by table look-up in a vector output PROM 110.

Specifically, PROM 104 generates the following counting codes and normalized vectors

| Number of Vector units | Counting Code | Normalized vector |
|---|---|---|
| less than 16 | 1 sub-vector | X 1 |
| 16–31 | 2 sub-vector | X .5 |
| 32–63 | 4 sub-vector | X .25 |
| long vector command | 2 sub-vector | X .25 |

Operation of digital vector generator 54 is controlled by the:

1. rotate/reflect (ROT/REF) bits from DPW Register 92.
2. step scale factor (SSF) from DPW Register 92.
3. repeat scale factor (RSF) from which multiplies the number of times that the line is drawn.
4. long vector command code (bits 16–19 of a vector command shown in FIG. 3(*a*) ) which causes the vector to be drawn in one-half the correct number of steps.
5. Long vector mode (bit 15 of a vector command shown in FIG. 3(*a*), which causes the X/Y vector to be drawn twice its normal size.

To further illustrate the operation of DVG 54, assume data source 38 sends vector commands as follows to DVG 54:

| | |
|---|---|
| X + 63, Y + 63 | first vector command |
| X + 63, Y − 63 | second vector command |

DVG 54 generates four (4) sub-vectors in response to the first vector command as follows:

| | |
|---|---|
| X + 15, Y + 15 | sub-vector #1 |
| X + 16, Y + 16 | sub-vector #2 |
| X + 16, Y + 16 | sub-vector #3 |
| X + 16, Y + 16 | sub-vector #4 |

In response to the second vector command, DVG 54 generates four (4) sub-vectors as follows:

| | |
|---|---|
| X + 15, Y − 15 | sub-vector #5 |
| X + 16, Y − 16 | sub-vector #6 |
| X + 16, Y − 16 | sub-vector #7 |
| X + 16, Y − 16 | sub-vector #8 |

Actually, the eight (8) sub-vectors are 15.75 units each. However, the fractional bits are not interpreted by digital to analog converters 60 and thus have no effect on beam position. Even though the fractional bits are ignored, the XP and YP registers, 132 and 134, respectively (shown in FIG. 9) are updated with the fractional information to maintain complete accuracy.

Figure 6:
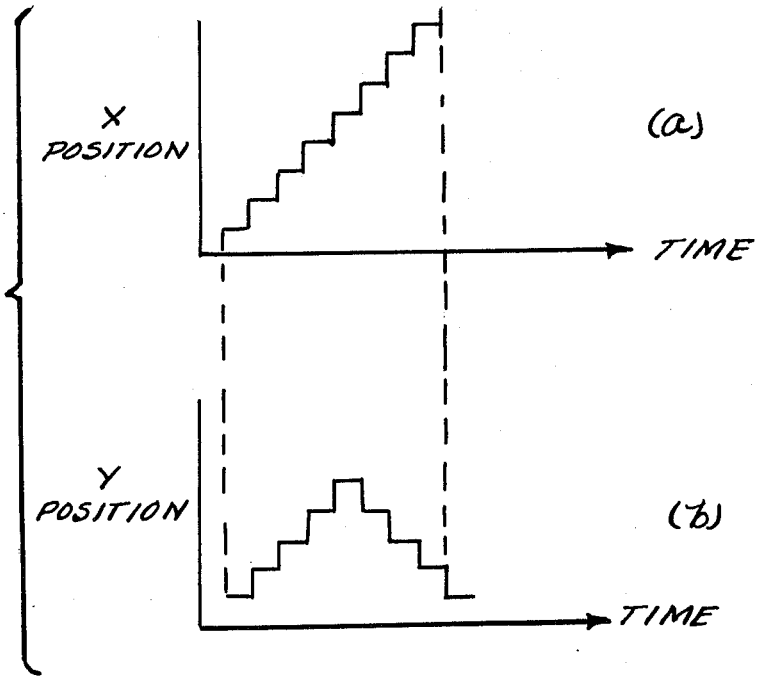
FIG. 6 is a graphical representation showing the outputs of the X and Y digital to analog converters.

The eight (8) sub-vectors, generated in response to the first and second vector commands will after processing by ALU circuit 56 and X and Y DACs 60 ultimately result in positional signals being generated by the X and Y DACs as plotted in FIG. 6. FIG. 6(*a*) illustrates the changes in X position with respect to time for the eight (8) sub-vectors and FIG. 6(*b*) illustrates the corresponding changes in Y position with respect to time.

In essence, DVG 54 decomposes a vector into sub-vectors having fractional coordinates of the vector by dividing the vector's coordinates by $2^M$ where M is the smallest number that yields sub-vectors smaller than a predetermined maximum sub-vector length. DVG 54 then generates $2^M$ sub-vector commands by successive addition of the fractional coordinate values derived by decomposing.

Long Vector Operation

The advantages derived from the hybrid digital-/analog vector generating technique are even more pronounced in the drawing of long vectors, i.e., over 63 vector units. The errors associated with conventional analog vector generators become even more pronounced as the vectors drawn become longer. To overcome the errors normally associated with drawing long vectors, vectors longer than 63 vector units are divided into plural medium length vectors of 63 vector units or less by data source. Specifically, the division of long vectors (over 63 vector units) into medium length vectors (63 vector units or less) is carried out by the same technique used in DVG 54 to break medium length vectors into one or more sub-vectors. However, as alternatives, other techniques could be used to divide long vectors into medium length vectors.

The command for the first of these medium vectors includes a "long vector command" and "long vector mode" false. A "long vector command" causes a vector to be drawn in two (2) steps and divided by four (4), with only two of the steps being sent. Thus, the effect of a "long vector command" alone is the drawing of only half a vector. Therefore, the effect of the combination of "long vector command" and "long vector mode" false is the drawing of a vector at the normal drawing speed but for one-half of the correct number of iterations. Thus, at the end of the first vector command, the beam will have moved one-half of the distance appropriate for that vector command. The remaining medium vectors are transmitted to FIFO 53 with the "long vector mode" (bit 15) true and with a "long vector command". A "long vector mode" true causes sub-vectors to be multiplied by two (2). The net effect of a simultaneous "long vector command" and "long vector mode" true is the drawing of a vector at twice normal speed. Thus, the middle portion of the long vector is drawn with "long vector command" true and "long vector mode" true. This causes the number of iterations in the vector to be one-half of the nominal number while causing each step to be twice as large. The net effect is that the beam will continue to draw in the same direction but at double the normal speed.

After the middle portion of the vector is drawn, data source 38 re-transmits the first of the medium vectors. However, in this re-transmitted vector, there is a "long vector command" and "long vector mode" is false. This final step causes the beam to decelerate to the normal drawing rate and completes the partially drawn first vector command so that the proper end point is reached. Because the center portion of the vector is drawn at twice the rate of speed of the end points it is necessary to increase the beam intensity during that period to create the appearance of constant brightness on the drawn line.

Figure 7:
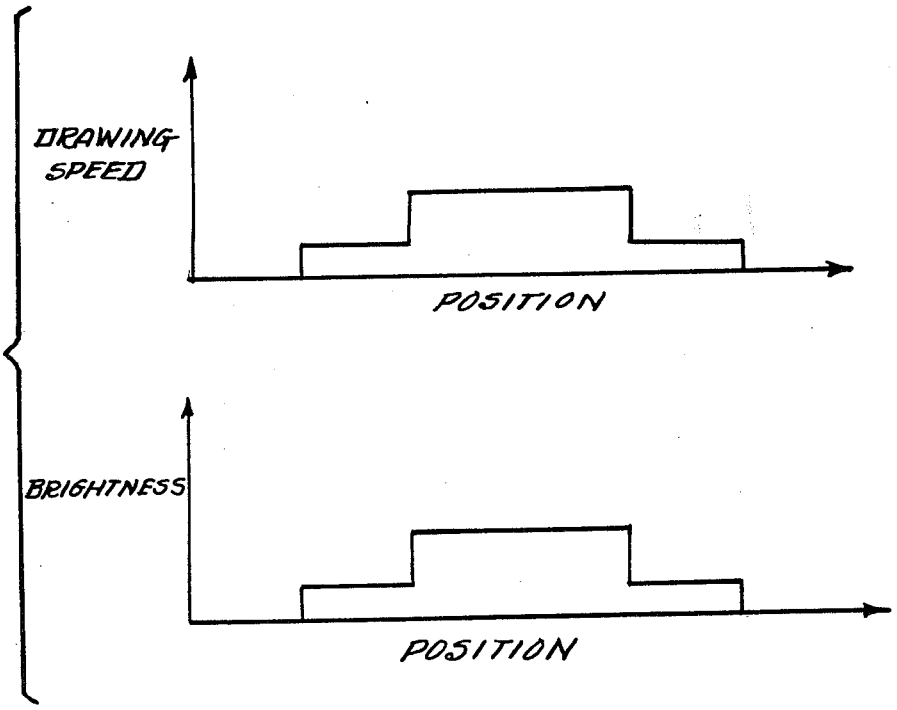
FIG. 7 is a graphical representation illustrating the step changes in drawing speed for long vectors and the accompanying brightness compensation allowing long vectors to be drawn with uniform brightness.

Referring now to FIG. 7 there are shown graphically, plots of drawing speed and brightness vs. beam position illustrating the manner in which long vectors are drawn and their brightness compensated. The use of a stepwise change in drawing rates renders the compensation of brightness much less complicated than it would otherwise be with a gradually accelerating or decelerating drawing rate. As an alternative, the beginning and ending speeds may not be identical. The important feature is that the drawing speed changes in a stepwise manner so that the brightness can be easily compensated according to a scheme such as illustrated in FIG. 7.

Figure 8:
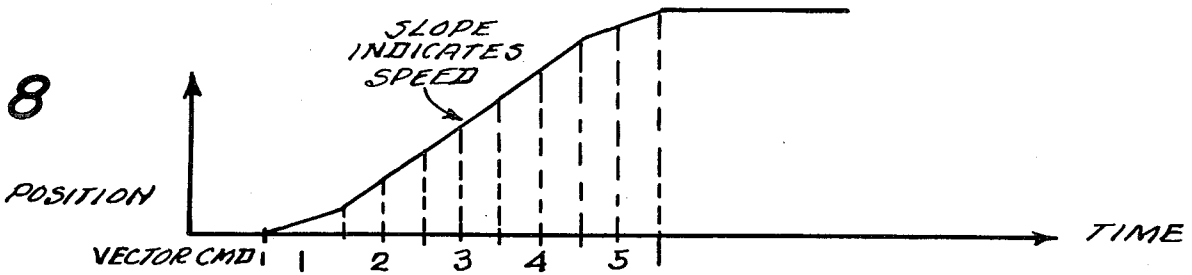
FIG. 8 is a sample long vector profile of beam position vs. time wherein the slope of the line indicates vector drawing speed.

A sample long vector profile as shown in FIG. 8. The vector commands plotted on the horizontal axis are five vector commands. It should be noted that the fifth and final vector command is a re-transmission of the first vector command. The profile is a plot of beam position vs time and the drawing speed is indicated by the slope.

A significant advantage of this long vector drawing technique is that line beginnings and endings are drawn at the normal drawing rate and are thus as precise and sharp as possible. Were the entire vector to be drawn at twice the normal drawing rate the errors at the vector end points would be twice as large. While it is true that long vectors are not truly constant velocity vectors, the changes in velocity are extremely well behaved and can be easily compensated as illustrated in FIG. 7.

In essence, long vectors are decomposed into at least two (2) medium length vectors by dividing the long vector's coordinates by $2^N$ where N is the smallest number that yields medium length vectors less than a predtermined length. These medium length vectors are then decomposed by DVG 54 into sub-vectors, as previously discussed.

ALU Circuit

Figure 9:
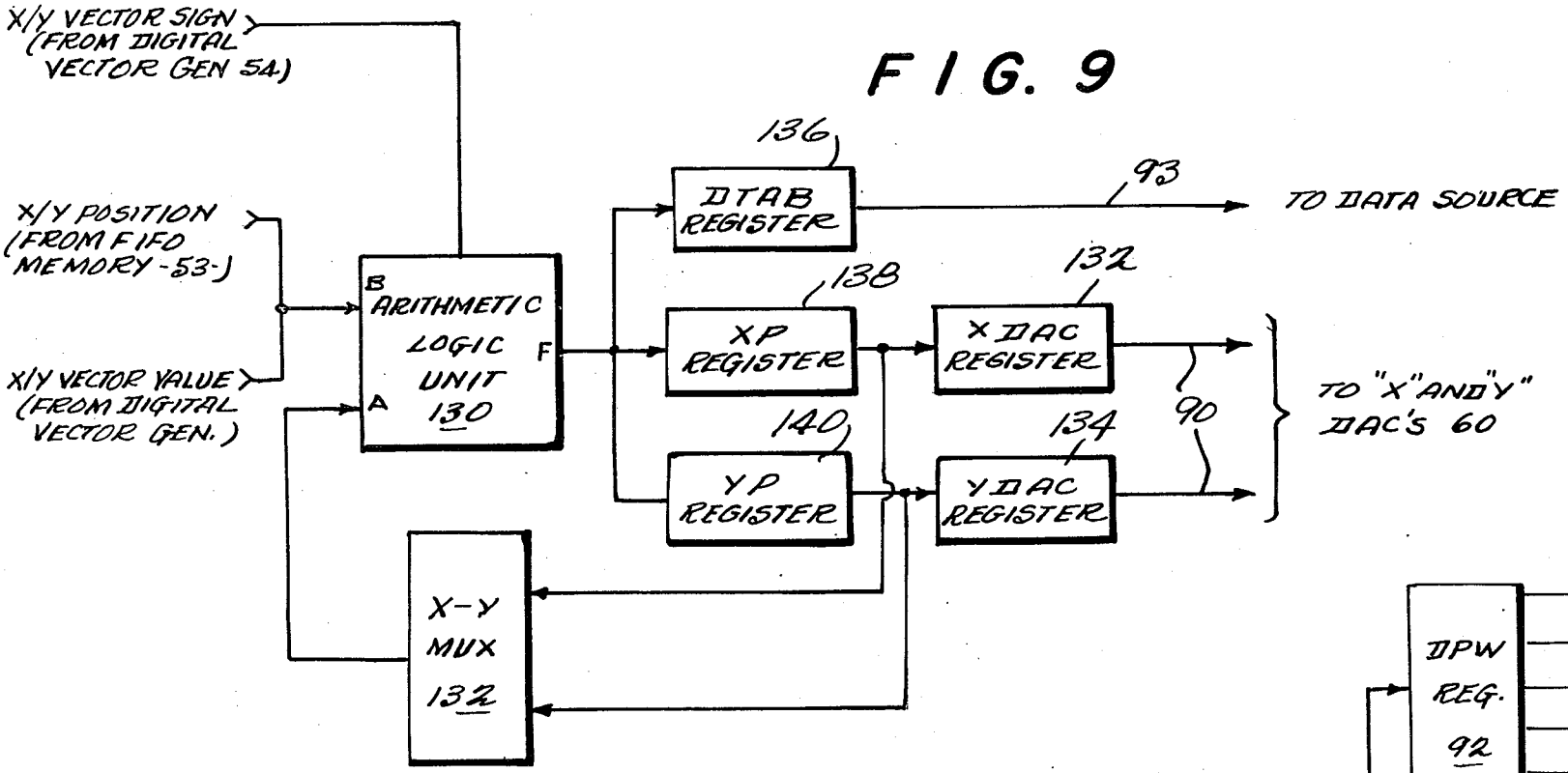
FIG. 9 is a more detailed block diagram of the arithmetic logic unit circuit.

Referring now to FIG. 9 there is shown a more detailed block diagram of ALU circuit 56. ALU circuit 56 includes an Arithmetic Logic Unit (ALU) 130 for computing successive beam positions based upon the sub-vectors from DVG 54. ALU 130 actually computes X+X and Y+Y to obtain new X and Y positions. The current X and Y positions are stored in XP and YP registers 138 and 140, respectively. As in DVG 54, X and Y coordinates are processed serially and two cycles are required to compute the updates for X and Y coordinates. ALU 130 adds the X of Y vector magnitude to the current position of the coordinate; when the sign of the sub-vector indicates decreasing coordinate values it is subtracted. An X/Y multiplexer (MUX) 132 provides appropriate current coordinate values from XP register 138 and YP register 140 to ALU 130.

When the X or Y values are to be set explicitly by a command on line 118, the new X or Y coordinate value is presented at the B input of ALU 130 and a zero to the A input thereof. Using an add function, the XP or YP register will be correctly set to the new position. Separate X-DAC and Y-DAC registers 132 and 134, respectively latch updated coordinate values from registers 138 and 140, respectively to assure that both coordinate values change at the same instant in time, i.e. on the same clock pulse. Without these registers, an intended diagonal line would instead appear as a horizontal line followed by a vertical line on tube 44. A DTAB register (REG) 136 for transferring data back to data source 38 via line 93 can be loaded with the current values of the XP 138 or YP 140 registers directly from ALU 130. DTAB register 136 can also be loaded with data directly from FIFO memory 53 via the X/Y position input 118 to ALU 130. In this manner not only can data source 38 sample the X and Y values but also a label attached to them at the time the request was made.

"X" and "Y" Digital To Analog Converters 60

"X" and "Y" DACs 60 generate an analog signal representing the changing values stored in X DAC Register 132 and Y DAC register 134 of ALU circuit 56. In essence, DACs 60 provide staircase signals representing the changing values of the X and Y positions. A block/schematic diagram of either X or Y DAC 60 is shown in FIG. 10.

Figure 10:
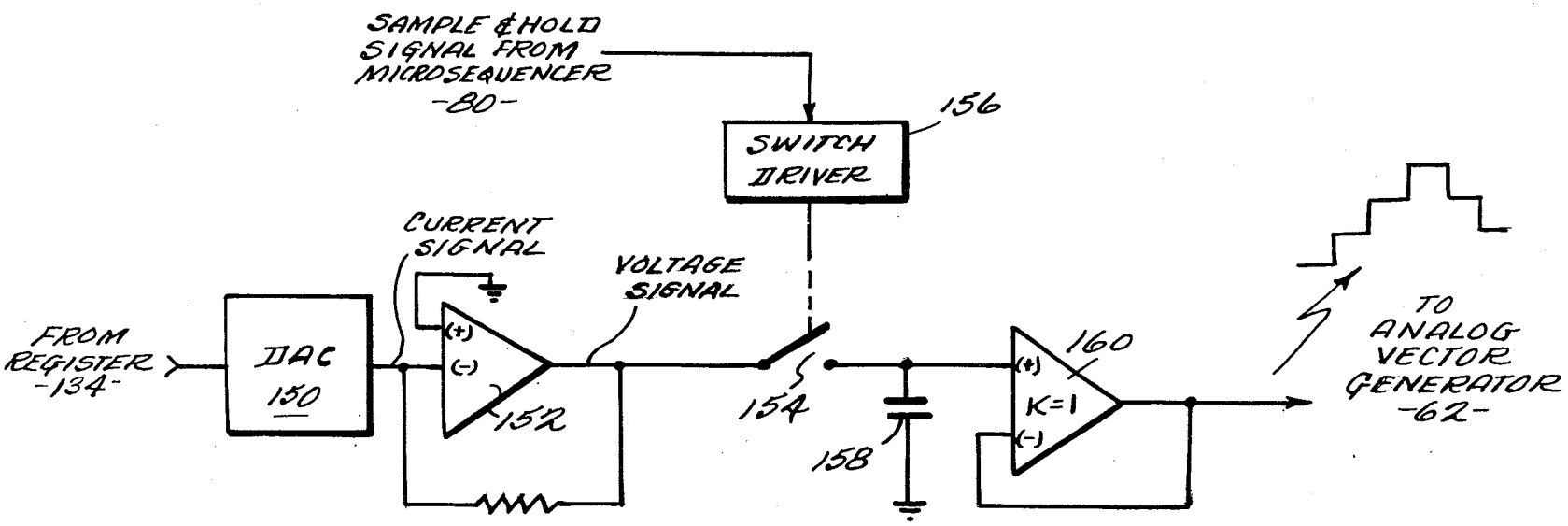
FIG. 10 is a block/schematic diagram of the digital to analog converter.
Figure 11:
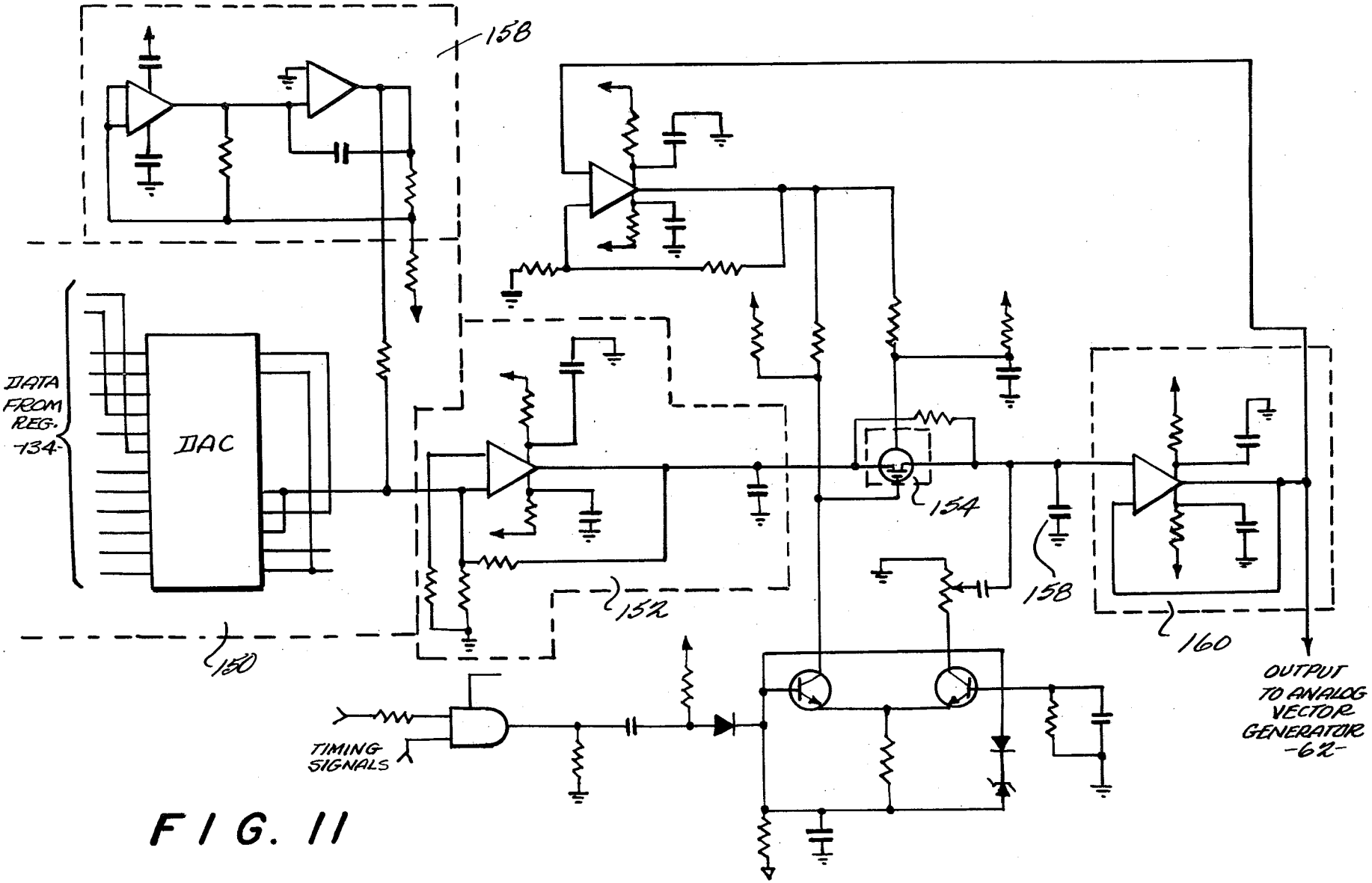
FIG. 11 is a detailed schematic diagram of the digital to analog converters.

Referring now to FIG. 10 there is shown a more detailed block/schematic diagram of either digital to analog converter 60. The "X" digital to analog converter 60 is identical and therefore is not shown. Digital value signals from either register 132 or 134 are coupled to a digital to analog converter element (DAC) 150 wherein they are converted to a current signal. The current signal generated by DAC 150 is coupled to an amplifier 152, the output of which is coupled to a switch element 154. Switch element 154 is operated by a switch driver 156 which in turn is activated by a sample and hold signal from microsequencer 80. By operating switch 154, the voltage signal at the output of amplifier 152 is sampled and stored by a capacitor 158. This stored signal is coupled through a unity gain amplifier 160 to analog vector generator 62. It is necessary to sample the output of amplifier 152 in this manner to suppress the effect of current "glitches" that are characteristic of digital to analog converters when their input changes. A detailed schematic diagram of Y digital to analog converter 60 is shown in FIG. 11 which also includes a detailed schematic diagram of one of the Y oscillators 58. The X oscillator 58 is identical to Y oscillator 58.

Referring now to FIG. 11, DAC elements 150 is a standard off the shelf digital to analog converter. Amplifier 152 is implemented with an operational amplifier, in circuit as shown. Switch 154 is implemented by a solid state switching element, and unity amplifier 160 is implemented with another operational amplifier in circuit as shown. Oscillator 58, coupled to an input of amplifier 152 (not shown on FIG. 10) shifts the image on the face of tube 44 slowly so that a repeated image will not "burn-in" and ruin the phosphor coating on the face tube.

Analog Vector Generator 62 and Output Amplifier 82

Figure 12:
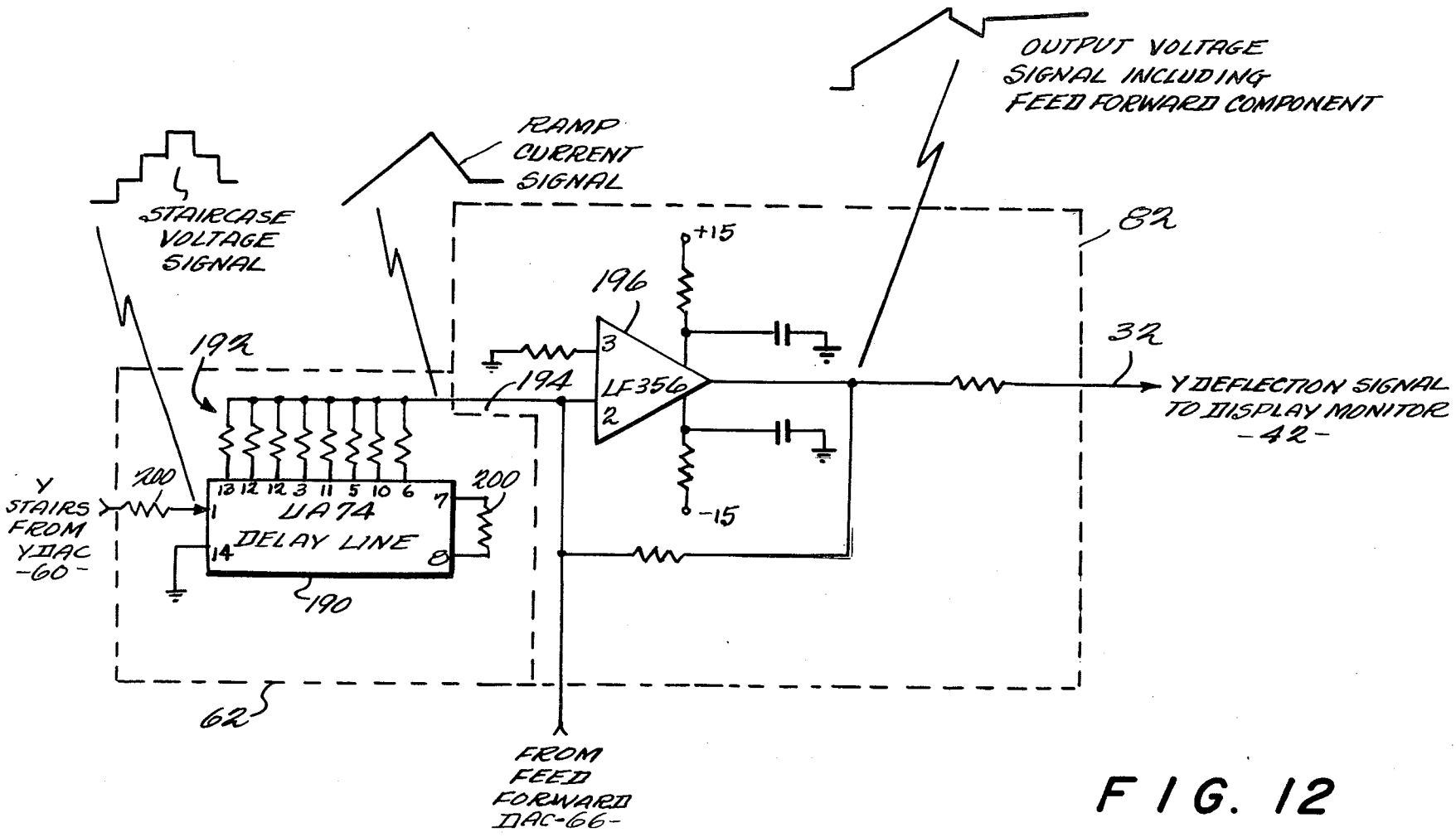
FIG. 12 is a schematic diagram of the analog vector generator and output amplifier.

Referring now to FIG. 12 there is shown a detailed schematic diagram of analog vector generator (AVG) 62 and output amplifier 82. Only the "Y" channel is shown; the "X" channel being identical. AVG 62 generates a smooth analog signal from the staircase samples from the output of DACs 60. AVG 62 comprises a delay line 190 with a resistor network 192 summing its intermediate outputs. Since practical analog delay lines, such as delay line 190 have a rise time on the order of the delay per intermediate output tap, the actual output obtained on line 194 is smooth.

Output amplifier 82 is implemented with an LF 356 operational amplifier in circuit as shown. Identical AVGs and output amplifiers are used for X and Y deflection signals.

Figure 13:
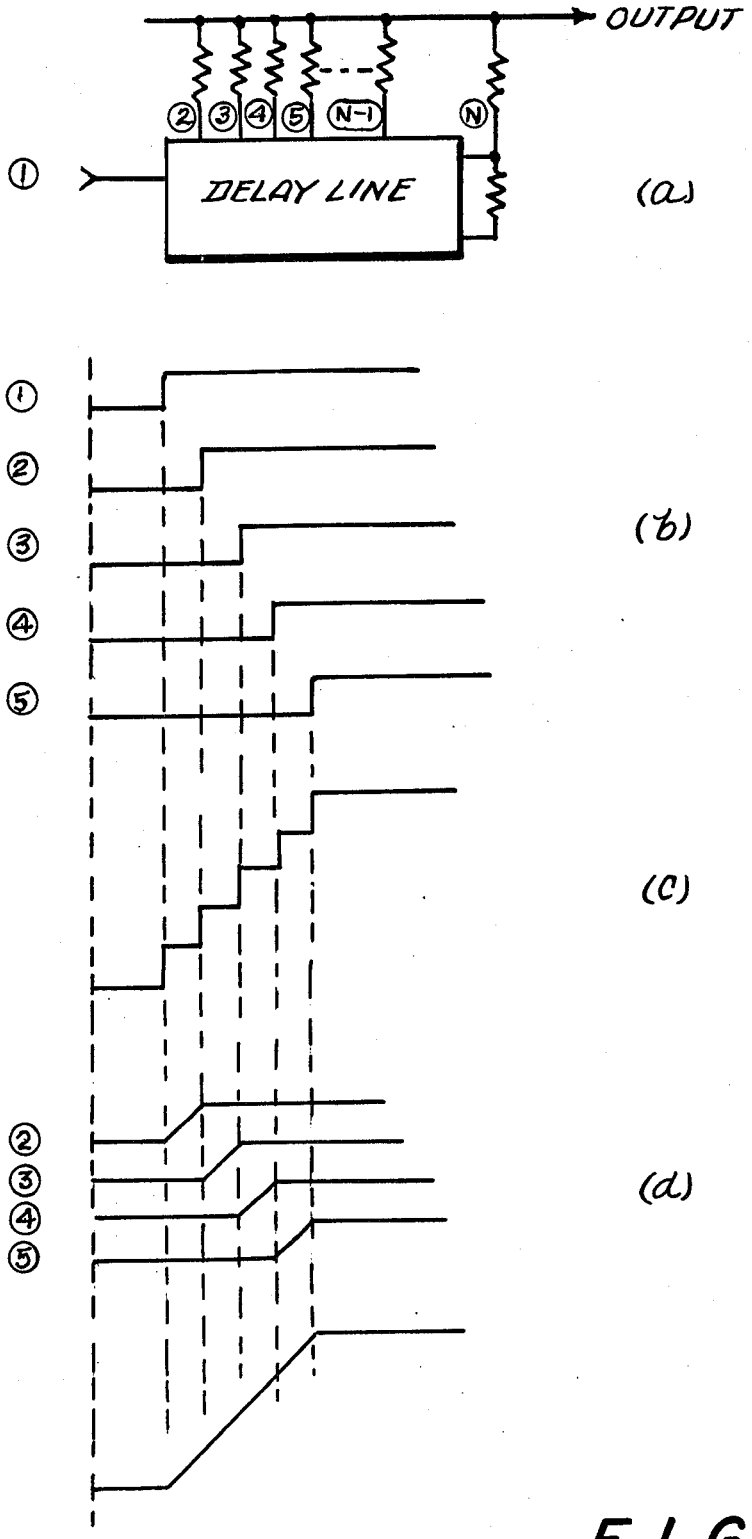
FIG. 13 illustrates the operation of the analog vector generator.

The theory and operation of AVG 62 is illustrated in FIG. 13. FIG. 13 (*a*) schematically depicts a delay line having an input 1, intermediate taps 2 to N−1 and an output tap N. The step input shown on line 1 of FIG. 13 (*b*) represents one of the steps of the staircase signal from Y DAC 60. The desired AVG response to a step is a ramp.

In theory, the waveforms obtained at taps 2–5 of the delay line are as shown in lines 2–5 of FIG. 13 (*b*). When summed, they would produce a staircase signal as shown in FIG. 13 (*c*). However, practical delay line devices that are commercially available have a finite rise time (as opposed to the zero rise time assumed in FIG. 13 (*b*)). Thus, the signals at the various taps actually appear as shown in FIG. 13 (*d*) and sum to produce the ramp shown in FIG. 13 (*e*). Thus, the "practical" delay line approximates an ideal filter that would produce a ramp from a step input.

Feed Forward Circuit

Figure 14:
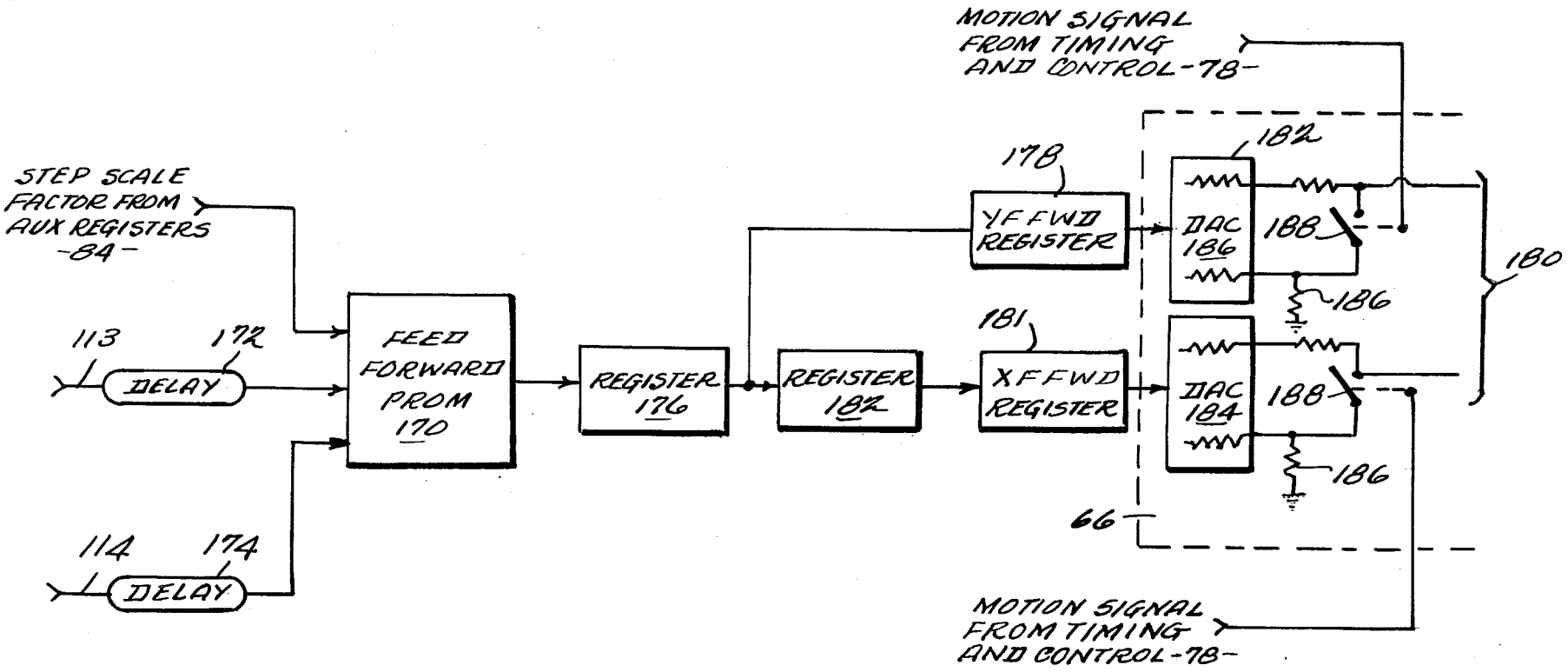
FIG. 14 is a detailed block diagram of the feed-forward circuit and feed-forward digital to analog converter.

Referring now to FIG. 14, there is shown a more detailed block diagram of feed forward circuit 64. Feed forward circuit 64 compensates to a significant degree for the sluggish response of amplifiers 46 and 48 of display monitor 42 (see FIG. 1) in changing the magnetic energy in yoke 50. When amplifiers 46 and 48 fail to respond rapidly, the visual effect is a shortening of the line on the screen so that it does not reach its end points or a rounding of the corner between successive vectors. While this effect can be alleviated by lengthening the period of time during which the beam is displayed, or by delaying between successive vectors, lines with bright spots at each vector ending will result from excessive delays. Therefore, the purpose of the feed forward circuit is to provide an input signal to amplifiers 46 and 48 that causes the amplifier response to equal the desired one, i.e., the input signal is modified to compensate for the dynamic characteristics of the amplifier. Here, the input is the desired amplifier response plus a digitally derived feed forward signal on a line 180 (see FIG. 2) equal to the derivative of the input waveform. Use of a digital circuit is preferred because analog differentiators are imprecise and exaggerate the noise component of the signal. In a vector processing system where the input voltages to the X and Y amplifiers are in fact computed from digital signals, it is straightforward to derive a precise and noise-free step voltage that is representative of the slope of the drawn line.

Feed forward circuit 64 provides a step signal proportional to the slope of a sub-vector. This step signal is preferably proportional to the first derivative (the slope) of the sub-vector. However, as an alternative, it may be proportional to the second derivative or may have some other function. When this step signal is combined with the analog vector signal from analog vector generator 64, in output amplifier 82, it "pre-distorts" the analog signal to improve the responsiveness of amplifiers 46 and 48. A feed forward PROM 170 is provided with the noramlized vector coordinates and corresponding sign from digital vector generator 54 and with the current value of the step scale factor (SSF) from DPW Register 92. PROM 170 contains a lookup table for converting the sign-plus-magnitude representation of a sub-vector into a two's complement form suitable for driving a digital-to-analog converter. This two's complement value is temporarily stored in a Register 176. For small step scale factors the feed forward signal is proportionate to the actual sub-vector length. The effects of larger step scale factor values are ignored. As with ALU circuits 56, X and Y coordinate values are computed successively. It is therefore necessary to use an additional set of registers 178 and 181 with Register 180 being loaded through an additional register 182. In this manner, the X and Y steps are applied at the same instant of time to Feed Forward DACs 66. This circuit ignores the effect of long vector mode on step size since the transition from moderate speed to high speed is intended to be a smooth one. Delay elements 172 and 174 which are latches provide the appropriate coincidence between the feed forward step signal and the signal from analog vector generator 62.

Feed Forward DAC 66 comprises DACs 196 and 198 with switches controlled by timing and control circuit 78. The digital feed forward signal from Registers 170 and 181 are coupled to digital-to-analog converters 182 and 184 which creates an analog+FFWD signal and an equal but opposite analog−FFWD signal. Following digital-to-analog converter 66 are resistor networks 186 and analog switches 188 that create the final feed forward signal on line 180. When switch 188 is open, the output one line 180 is equal to the analog+FFWD value. However, when switch 184 is closed the output on line 180 is a fraction of the analog−FFWD signal. Switch 188 is closed whenever the beam is stationary between vectors and open while vector drawing is taking place. The use of a high speed analog switch in this position makes it possible to precisely control the timing of the feed forward signal. The purpose of the fractionally minus voltage when the switch is closed during zero motion is to back up the beam prior to line drawing. A similar overshoot effect is achieved at the vector end by providing an excessive feed forward signal. The combined effect of these two processes is to compensate for the small difference between amplifier response with feed forward and the ideal response. The operation of Feed Forward Circuit 64 and Feed Forward Digital-to-Analog converters 66 is shown in FIGS. 15 and 16.

Figure 15:
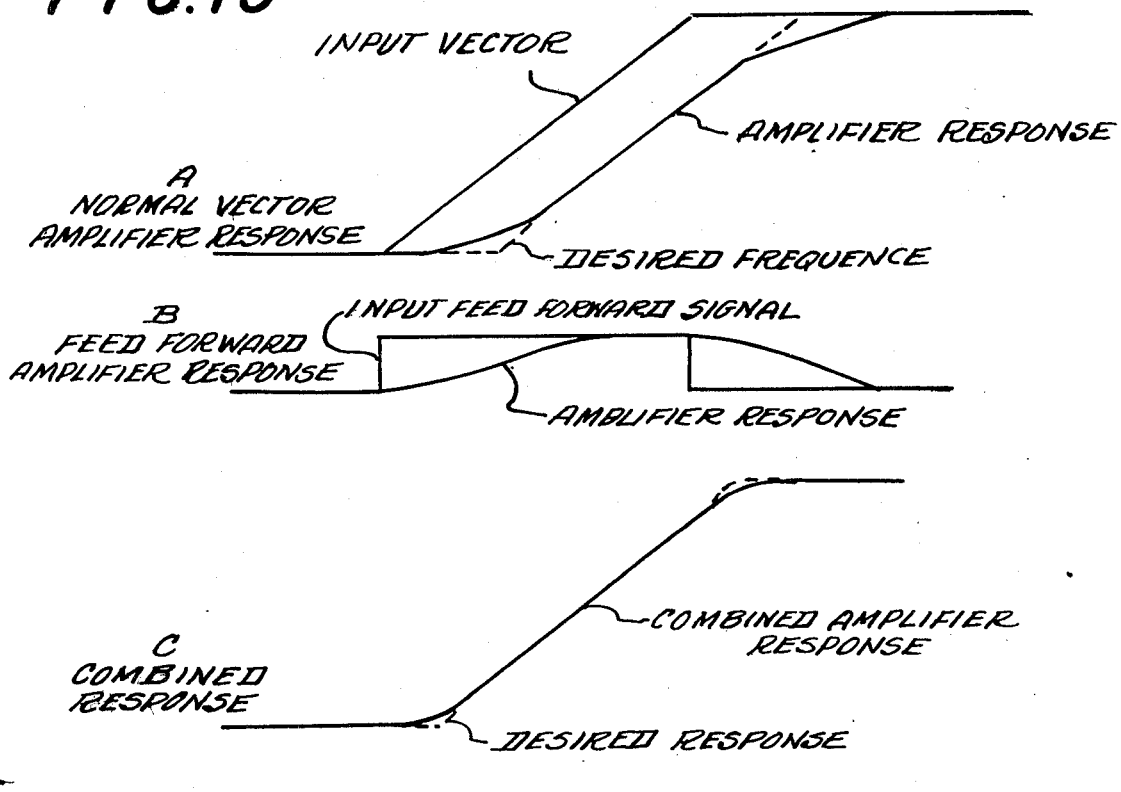
FIG. 15 is a graphical representation of the effect of the feed forward circuit.

Referring now to FIG. 15 there is shown a graphical plot showing an input vector, the desired response of a monitor amplifier and the normal amplifier response obtained from a conventional monitor amplifier. As can be seen, the response to the monitor amplifier is sluggish. The rise is not as sharp as desired and it does not reach maximum value sharply. In FIG. 15(*b*), there is shown an input step signal along with the response of a monitor amplifier to that step signal. In FIG. 15(*c*) when the step signal shown in FIG. 15(*b*) is added to the input vector signal shown in 15(*a*), the combined amplifier response much more closely approximates the desired amplifier response shown in dotted line in FIG. 15(*a*). Of course, there is still a slight difference between the desired and actual amplifier response at the beginning of the rise and at the end of the rise. The slight "backing-up" caused by the minus FFWD signal compensates for this remaining difference.

Figure 16:
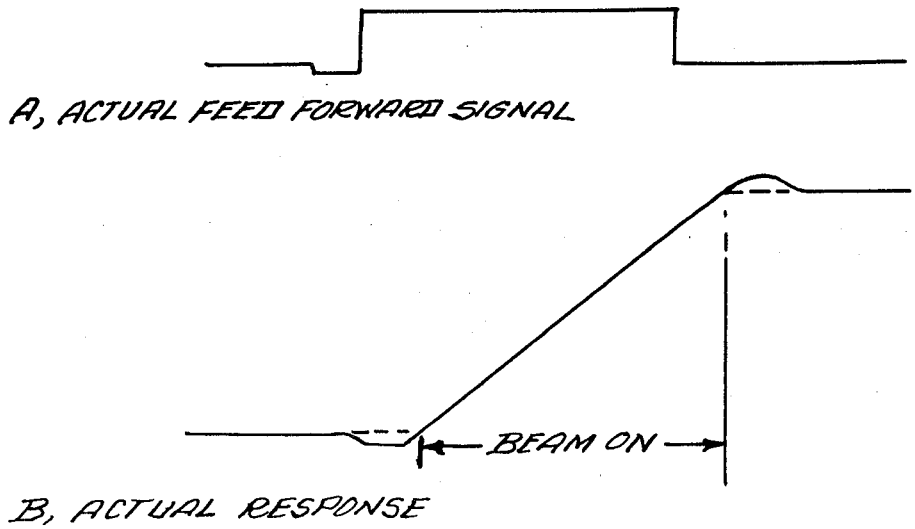
FIG. 16 is a graphical representation of the response of a display monitor amplifier to a feed-forward signal coupled thereto.

Referring now to FIG. 16, there is illustrated in 16(*a*) a feed forward step signal including a small negative portion before the leading edge thereof. This small negative portion in essence backs up the beam so that it can get a "running" start. By virtue of this running start, the actual amplifier response is substantially identical to the desired response shown in dotted line in FIG. 15(*a*). With the addition of a feed forward signal, the AVG signal shown at the output of delay line 190 in FIG. 12 is modified to appear as shown at the output of amplifier 196 (within output amplifier 82).

Thus, feed forward circuit 64 and feed forward DACs 66 are useful in improving the responsiveness of monitor amplifiers 46 and 48 (see FIG. 1) and thus the accuracy of vectors displayed on tube 44. Images are created on the face of tube 44 by activating its cathode beam while simultaneously and smoothly changing the X and Y deflection signal controlling beam position. It is desirable to perform this function at as high a rate of speed as possible. This is especially true in random refresh vector drawn displays such as graphic system 40 wherein the entire image must be redrawn many times during each second to avoid the appearance of flicker. The vector drawing rate in random refresh display systems are actually limited by the responsiveness of amplifiers 46 and 48, the feed forward compensating arrangement in graphic system 40 allows the use of much higher drawn rate thereby permitting more data to be on the face of tube 44 without flicker.

Grey Level Circuit

Figure 17:
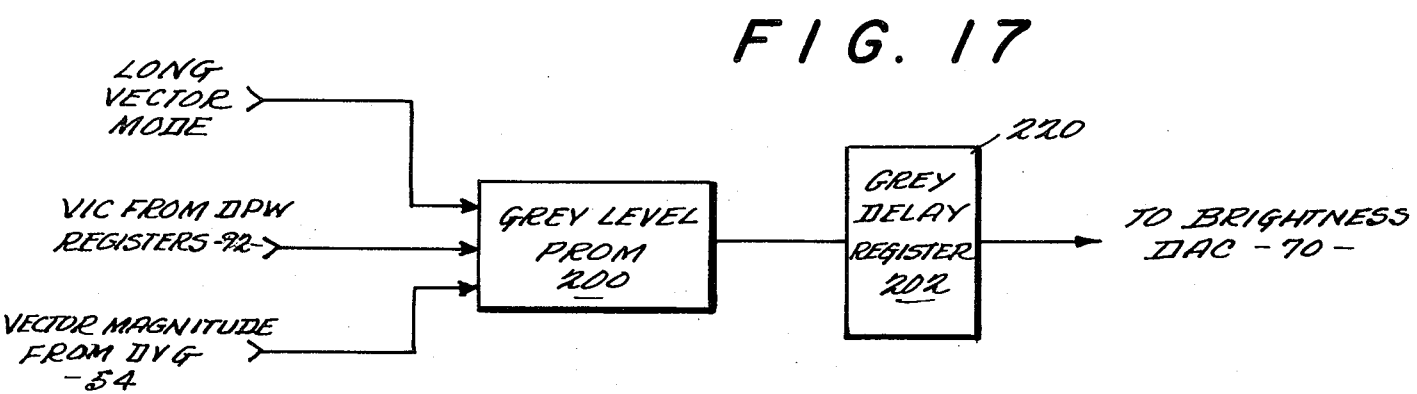
FIG. 17 is a detailed block diagram of the grey level circuit.

Referring now to FIG. 17, there is shown a more detailed block diagram of grey level circuit 68. Grey level circuit 68 computes the brightness value based upon the length of the current sub-vector, the desired variable intensity as stored in auxiliary registers 81, and the higher drawing rate associated with the long vector mode. A grey level PROM 200 serves as a function generator (a look-up table) in which a brightness value is determined based upon the length of the vector being drawn and how bright the use wants the vector to appear. Vector length is determined from the vector magnitude from DVG 54 and from "long vector mode" from a vector command. No attempt is made to compensate brightness based upon the step scale factor (SSF). The look-up table result must be delayed using grey delay registers 202 so that the brightness signal will correlate with the corresponding vector being drawn.

Delta Theta Circuit

As previously stated, delta theta circuit 76 improves the sharpness of corners formed by the meeting of two sub-vectors. Without delta theta circuit 76 two successive vectors, meeting to form a sharp corner, would actually appear on the face of tube 44 as a soft or rounded corner. This visual effect results from the sluggishness of amplifiers 46 and 48 in display monitor 42 that cannot be eliminated by feed forward circuit 64. Feed forward circuit 64 was intended to compensate for this slugishness during the drawing of each vector. Delta theta circuit 76, carries this compensation one step further in order to achieve a sharp corner. Specifically, intended sharp corners are rounded by virtue of the finite time it takes for amplifiers 46 and 48 to settle. In essence, delta theta circuit 76 temporarily freezes the clock on which microsequencer 80 operates to delay the beginning of the second of two successive vectors. This delay provides sufficient time for amplifiers 46 and 48 to settle and allows them to respond effectively to the appropriate beginning point of the second vector. Of course, each of the two successive vectors is also compensated by feed forward circuit 64 in the manner described above.

Figure 18:
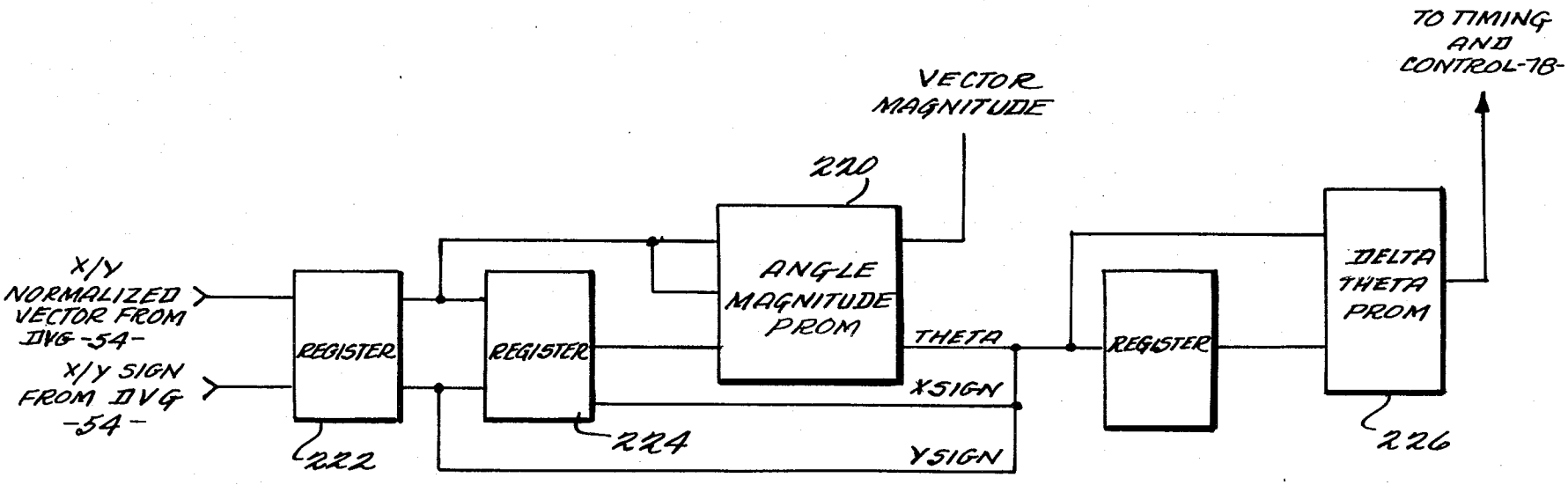
FIG. 18 is a detailed block diagram of the delta-theta circuit.

Referring now to FIG. 18, there is shown a more detailed block diagram of Delta Theta Circuit 76. Delta theta circuit 76 compares the direction of the to-be-drawn vector with the previous one to determine what delay, if any, is necessary to allow the amplifiers in the display monitor to settle. The computation of delta theta is performed in a two step process. First, for each vector, a direction code is computed; second, the direction code of the current vector is compared with that of the previous one and a decison made. The direction of the current vector consists of a theta or angle code which is computed in an Angle Magnitude PROM 220 from the normalized magnitude of the X and Y coordinates. This value is representative of the direction only within a single quadrant since the sign of the X and Y coordinates is not included. When combined with X sign and the Y sign the aggregate code is valid for all 360°. The purpose of registers 222 and 224 preceding the angle-magnitude PROM is to hold the computed X coordinate sign and magnitude while the Y coordinate sign and magnitude is being computed.

Delta theta itself is computed also by table lookup-this time in a delta theta Prom 226. The inputs to PROM 226 are the direction code of the current sub-vector and the stored direction code of the previous one.

Figure 19:
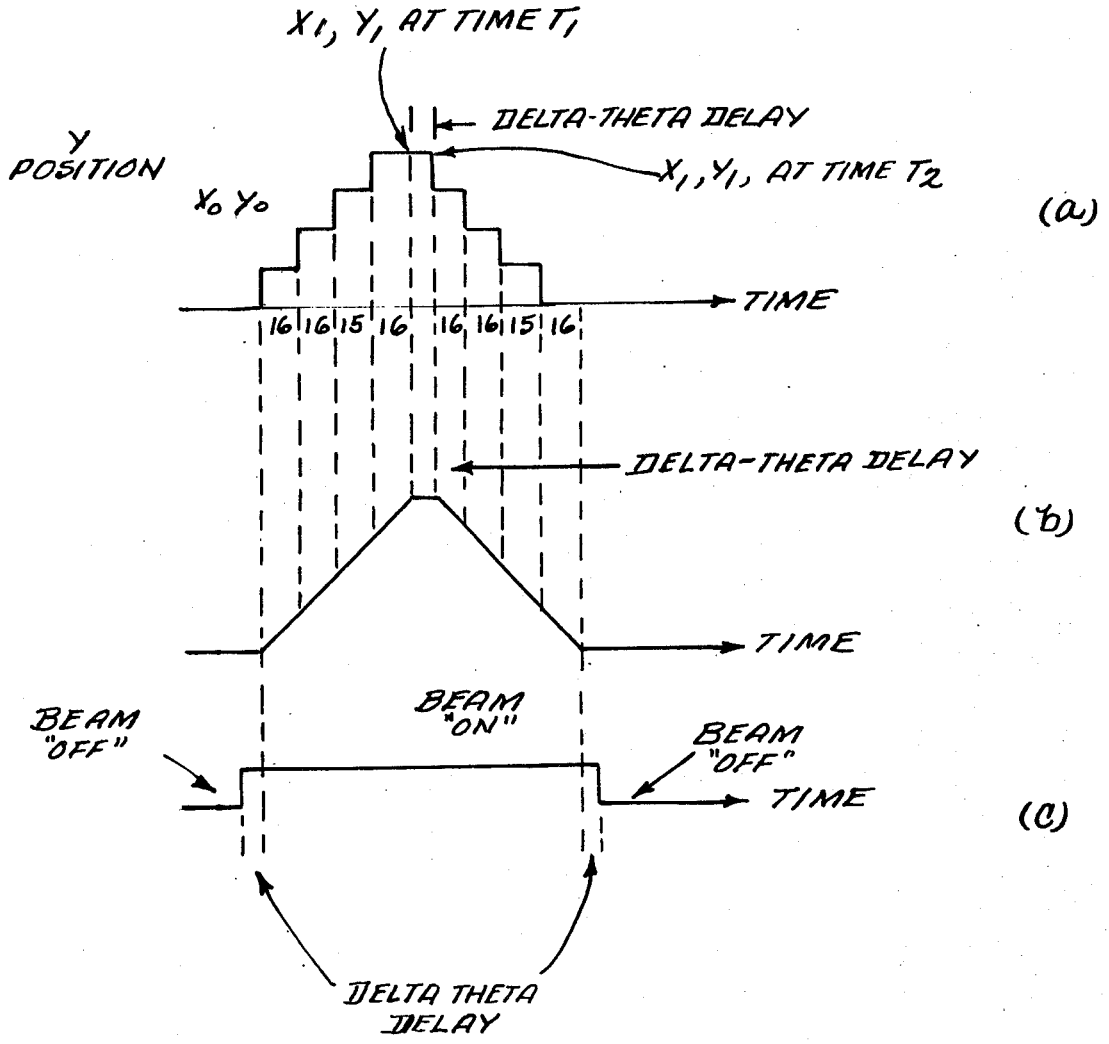
FIG. 19 is a graphical representation of the operation of the delta-theta circuit.

The delta theta result may effect a delay in the vector generation process by freezing the clock through timing and control circuit 78. In addition, a delay is generated at every transition between beam off and beam on to improve the precision of vector endpoints. These delays are illustrated in FIG. 18. FIG. 19(*a*) is a graphical representation of the Y positional changes including delay caused by Delta Theta circuit 76. The values illustrated are for the specific example discussed in the DIGITAL VECTOR GENERATOR portion of this description. The first vector command X+63, Y+63 is broken into four sub-vectors

| | |
|---|---|
| X + 15, Y + 15 | (sub-vector #1) |
| X + 16, Y + 16 | (sub-vector #2) |
| X + 16, Y + 16 | (sub-vector #3) |
| X + 16, Y + 16 | (sub-vector #4) |

which are plotted in four steps from a starting position XoYo. The end point of these four (4) sub-vectors is $X_1$, $Y_1$.

The second vector command X+63, Y−63 is broken into four (4) sub-vectors

| | |
|---|---|
| X + 15, Y − 15 | (sub-vector #1) |
| X + 16, Y − 16 | (sub-vector #2) |
| X + 16, Y − 16 | (sub-vector #3) |
| X + 16, Y − 16 | (sub-vector #4) |

However, the first of these four (4) sub-vectors does not begin at point X, Y, at time $t_1$. Rather, delta theta circuit 76 temporarily freezes the clock to give amplifiers 46 and 48 time to settle. Instead of sub-vector X+16, Y−16 beginning at point $X_1$, $Y_1$ at time $t_1$, it begins at point $X_1$, $Y_1$ at a later time $t_2$. The output signal of AVG 62 is plotted in FIG. 19(*b*), and the video output signal from texture generator 74 is shown in FIG. 19(*c*). As is illustrated most clearly in FIG. 19(*c*), the video beam of tube 44 is turned on slightly before the start of drawing of the first sub-vector and remains on slightly after the end of the drawing of the last sub-vector to allow time for amplifier settling.

Video Circuit and Texture Generator

Figure 20:
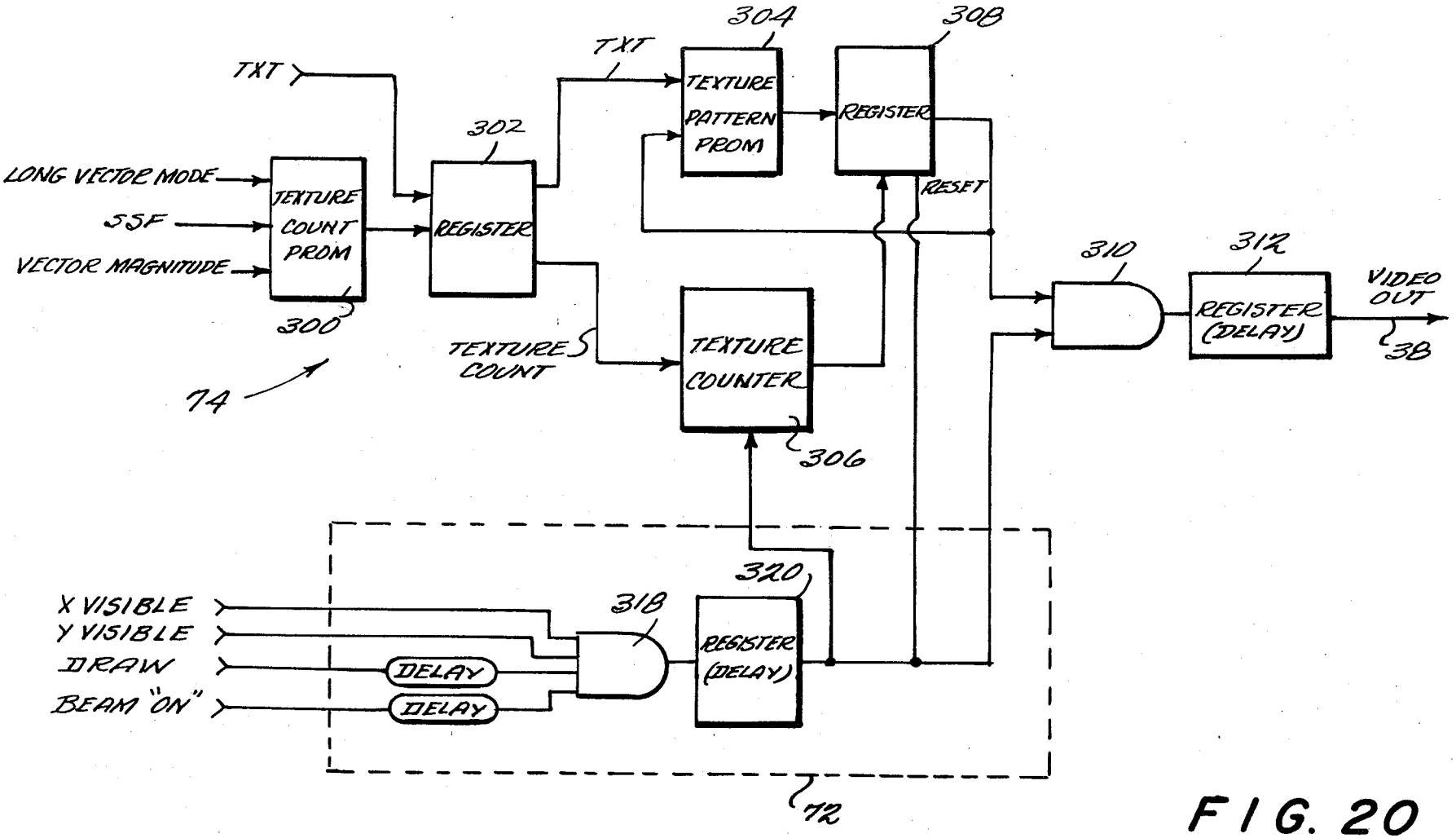
FIG. 20 is a detailed block diagram of the video circuit and texture generator.

Referring now to FIG. 20 there is shown a detailed block diagram of video circuit 72 and texture generator 74.

Information indicating the length of the current vector is coupled to a texture count PROM 300. Based upon this information, texture count PROM, acting as a look-up table, provides a count. This count evenly spaces the elements of a textured line of a vector, such as a dot or dash pattern. The count ultimately controls the number of clock pulses during which the beam of tube 44 will be "on" and "off" independent of the actual length of a vector.

The count from Texture Count PROM 300 latched into a register 302. In addition, the texture called for by a display command (see FIG. 3(*b*), bits 13 -15) is also latched into register 302. Register 302 synchronizes the texture count from PROM 300 with the texture information in a display command. The count latched by register 302 is transferred to a resettable texture counter 306.

Texture counter 306 determines how many high speed clock increments must occur before the texture generator advances to the next bit of the texture pattern.

The texture data latched by register 302 is transferred to a texture pattern PROM 304, coupled to a resettable register 308. Together, PROM 304 and register 308 operate as a state machine (microsequencer) and define the state of the pattern (beam "on" or beam "off") at any time. When the beam is "off" as defined by the signals coupled to video circuit 72, both texture counter 306 and register 238 are reset.

As stated, PROM 304 and register 308 operate as a state machine. Given the current state, coupled from the output of register 308 to one set of inputs of PROM 304 and given the mode of operation (TXT) coupled to the other set of inputs of PROM 304, a next state is outputted from the PROM. On the next strobe of register 308, the state is advanced to that defined by the output of PROM 304.

For example, states 0–7 may be "beam on" and states 8–15 may be "beam off" states. To create a dot pattern, PROM 304 would cause the state machine to go back and forth between states 0 and 8. For a dash, defined by three (3) lengths "on" and one (1) length "off", the state machine might go from state 0 to 1, 1 to 2, 2 to 3, 3 to 8, and 8 to 0.

The signal defined by register 308 is "anded" by an AND gate 310 with the signal from video circuit 72. Thus, in order for the beam to be on, two conditions must occur. The beam must be called for as on by the data coupled to video circuit 72 and the state machine must be one of states 0–7. The output of gate 310 is coupled through a delay register 312 in order to synchronize with the analog vector generator signals.

Various signals indicating whether the beam should be "on" or "off" are coupled to the input of video circuit 72. Essentially there are four such "intermediate" signals from various registers within system 40. These signals are X visible signal indicating whether the t position called for is actually on screen, a Y visible signal indicating whether the Y position called for is actually on screen, a DRAW signal indicating whether a vector is being drawn at all and a BEAM ON signal indicating whether the use has requested that the beam be on. The DRAW and BEAM ON signals are delayed by delay elements 314 and 316 respectively. All four signals are "anded" by an AND gate 318. A register 320 synchronizes the four intput signals to gate 318.

Summary of Detailed Description

Thus, it can be seen from this detailed description how all of the blocks shown in FIG. 2 cooperate to provide X and Y positional signals, a brightness signal (Z) and a video output signal for controlling beam "on" and "off". Display system 40 provides a high quality random refresh display control system by utilizing several techniques not previously employed in such systems.

The basic vector generating scheme utilizes a hybrid digital and analog technique. Vectors are broken into sub-vector components and then drawn by an analog vector generator. The analog vector generator, using a delay line minimizes the error normally associated with the analog vector generation of longer vectors.

A long vector drawing technique is incorporated. The technique utilizes step changes in drawing rate that are easily brightness compensated rather than a smooth acceleration or deceleration of the drawing rate. Using the long vector drawing technique, the beginning of a long vector is drawn at some "normal" drawing rate, the middle portion of the vector is drawn at a higher drawing rate, and the end portion of the vector is drawn at the "normal" drawing rate to reach its end point. The technique permits the long vector to be drawn accurately i.e. precisely pinpointing beginning and ending points, and to be brightness compensated so that it has the same brightness along its entire length.

A feed forward circuit is incorporated to overcome the inherent sluggishness of the X and Y deflection amplifiers associated with conventional display monitors. Feed forward circuit provides a step signal which is added to the analog position signal developed by the analog vector generator to give the display monitor amplifiers a "kick".

The sluggishness of the inherent "inertia" corresponding to time required for settling of the display monitor amplifiers is compensated by a delta theta circuit which temporarily freezes the system clock to delay the starting time of two successive vectors meeting at a sharp corner. This delta theta compensation allows the display amplifiers the needed time to settle so that the corner of the two successive vectors will be displayed sharply rather than smoothly. This, of course, provides a more eye-pleasing display.

Of course, other modifications and embodiments will be evident to those of ordinary skill in the art having the benefit of the teachings contained in this patent. Such obvious extensions or alternatives are intended to be within the scope of the appended claims.

What is claimed as new is:

1. In a display system synthesizing an image from a source of digital vector commands, a vector generating system providing in response to a digital vector command, analog deflection signals for an electronically driven display comprising:

a digital vector generator for generating, in response to a vector defined by said digital vector command, one or more digital subvector commands of substantially constant length; and an analog vector generator for generating, in response to each subvector command, a deflection signal for coupling to said display for drawing the sub-vector defined by the sub-vector command.

2. A system according to claim 1 wherein said analog vector generator comprises: a delay line having intermediate output taps; and means for summing the signals from said intermediate taps.

3. A system according to claim 2 wherein said means for summing comprises a resistor network.

4. A system according to claim 1 wherein said digital vector generator comprises:

means for identifying the length of a vector defined by a vector command coupled thereto; and a look-up table for selecting the number of sub-vectors into which said vector is to be divided.

5. A method for generating, in response to a digital vector command, an analog deflection signal for an electronic display, comprising the steps of:

generating, in response to said digital vector command, one or more digital sub-vector commands;

generating, for each digital sub-vector command, an analog deflection signal for driving said electronic display.

6. A method according to claim 5 wherein said step of generating an analog deflection signal comprises the steps of:

generating a plurality of delayed signals, each such delayed signal having a different amount of delay from the other delayed signals; and summing said delayed signals to produce said deflection signal.

7. In a graphics display control system which receives a digital display command and provides in response thereto a deflection signal suitable for driving a display monitor to display an image representative of said digital display command, the improvement comprising:

means for generating, in response to said digital display command, one or more digital sub-vector commands; and means for generating, for each digital sub-vector command, an analog deflection signal for driving a display, the analog generating means comprising:

a delay line having a plurality of intermediate output taps, said delay line receiving at its input voltage steps corresponding to a vector defined by a vector command; and a summing resistor network for summing signals derived at each of said intermediate outputs of said delay line, to provide a smooth deflection signal for coupling to said display monitor.

8. In a display system synthesizing an image from a source of digital vector commands, a method for drawing vectors comprising the steps of:

decomposing a vector defined by a vector command into sub-vectors having fractional coordinates of said vector by dividing the coordinates of said vector by $2^M$ where M is the smallest number that yields sub-vectors equal to or less than a predetermined maximum sub-vector length; and generating $2^M$ sub-vector commands, each such command defining a sub-vector, by successive addition of fractional coordinate values derived by said step of decomposing;

drawing each sub-vector in the same predetermined period of time so that each sub-vector is drawn with a constant velocity.

9. In a display system synthesizing an image from a source of digital vector commands, a vector generating system comprising:

means for decomposing a vector defined by a vector command into sub-vectors having fractional coordinates of said vector by dividing the coordinates of said vector by $2^M$ where M is the smallest number that yields vectors equal to less than a predetermined maximum sub-vector length; and means for generating $2^M$ sub-vector commands, each such command defining a sub-vector, by successive addition of fractional coordinate values derived by said step of decomposing;

means for drawing each sub-vector in the same predetermined period of time so that each sub-vector is drawn with a constant velocity.

10. A system according to claim 9 wherein said means for decomposing comprises:

means for identifying the length of a vector defined by a vector command coupled thereto; and a look-up table for selecting the number of sub-vectors into which said vector is to be divided.

11. In a display system synthesizing an image from a source of digital vector commands, a method for drawing vectors having greater than a first predetermined length comprising the steps of:

first decomposing a long vector of greater than a first predetermined length into at least two medium vectors of not greater than a second predetermined length less than said first predetermined length by dividing the coordinates of said long vector by $2^N$ where N is the smallest number that yields vectors equal to or less than said second predetermined length;

second decomposing each of said medium vectors into one or more sub-vectors having fractional coordinates of said medium vector by dividing the coordinates of said medium vector by $2^M$ where M is the smallest number that yields vectors equal to or less than a maximum sub-vector length;

generating $2^M$ sub-vector commands, each such command defining a sub-vector, by successive addition of fractional coordinate values derived by said second decomposing step; and drawing each sub-vector.

12. In a display system synthesizing an image from a source of digital vector commands, a vector generating system for drawing vectors having greater than a first predetermined length comprising:

first means for decomposing a long vector of greater than a first predetermined length into at least two medium vectors of not greater than a second predetermined length less than said first predetermined length by dividing the coordinates of said long vector by $2^N$ where N is the smallest number that yields vectors equal to or less than said second predetermined length;

second means for decomposing each of said medium vectors into one or more sub-vectors having fractional coordinates of said medium vector by dividing the coordinates of said medium vector by 2 where M is the smallest number that yields vectors equal to or less than a maximum sub-vector length;

means for generating $2^M$ sub-vector commands, each such command defining a sub-vector, by successive addition of fractional coordinate value derived by said second decomposing step; and means for drawing each sub-vector.

13. A method for writing a vector on an electronic display comprising the steps of:

writing a first portion of said vector at a first constant speed;

writing a second portion of said vector at a second constant speed greater than said first speed; and writing a third portion of said vector at a third constant speed less than said second constant speed.

14. A method according to claim 13 wherein said third speed is equal to said first speed.

15. In a graphics display control system for receiving display commands and providing in response thereto signals suitable for driving a monitor to display a pattern representative of said display command, the improvement comprising the use of a delta theta circuit comprising:

means for comparing the angle between first and second successive vectors;

means for determining a delay based upon the comparison in said means for comparing;

means for delaying said second vector by said delay in order to allow time for an amplifier of said monitor to settle, thereby improving the appearance of the display of successive parallel or near parallel vectors and sharp corners between two successive vectors.

16. An improvement according to claim 15 wherein said means for delaying comprises means for temporarily freezing a system clock associated with said graphics display control system.

17. In a graphics display control system for receiving vector commands and providing in response thereto signals suitable for driving a monitor to display a pattern representative of said display commands, the improvement comprising the use of a feed forward circuit comprising:

means for generating, in response to the change in direction of the current vector from its predecessor vector, a step signal representative of said difference;

means for adding said step signal to an analog vector signal related to said current vector to pre-distort the analog vector signal to compensate for the sluggishness of an amplifier associated with said monitor, thereby providing a sharp corner between said current vector and said predecessor vector.

18. An improvement according to claim 17 wherein said step signal is related to the first derivative of the current vector.

19. An improvement according to claim 17 wherein said step signal is related to the second derivative of the current vector.

20. A graphics display control system for generating signals suitable for driving an electronic display to produce a picture in accordance with digital display commands comprising:

a digital vector generator for receiving said display commands and generating sub-vectors in response thereto;

an arithmetic logic unit circuit coupled to the output of said digital vector generator for computing successive beam positions during vector generation and for storing the digital representation of a current beam position;

a digital to analog converter, coupled to the output of said arithmetic logic unit circuit, for generating an analog signal related to the successive beam positions computed by said arithmetic logic unit circuit;

an analog vector generator coupled to the output of digital to analog converters for generating analog sub-vectors responsive to the analog signal provided by said digital to analog converter and related to the sub-vectors generated by said digital vector generator.

21. A graphic display control system according to claim 20 further including a feed forward circuit for providing a step signal related to the slope of a sub-vector generated by said digital vector generator, said step signal for being combined with the output signal of said analog vector generator for improving the response of an output amplifier associated with said electronic display.

22. A graphics display control system according to claim 20 further including a grey level circuit for providing a brightness value signal related to the length of a sub-vector generated by said digital vector generator, said grey level circuit providing a signal for controlling the brightness of a line drawn on said electronic display by said graphic display control system.

23. A graphics display control system according to claim 20 further including a delta theta circuit for comparing first and second adjacent sub-vectors generated by said digital vector generator and providing in response thereto a delay of said second sub-vector allowing an amplifier associated with said electronic display to settle so as to display a sharp corner between said first and second sub-vectors.

24. A graphic display control system according to claim 23 wherein said delta theta circuit comprises means for computing a direction code for each of said two sub-vectors;

means for comparing the direction code of each sub-vector with the direction code of the other; and means for determining a delay appropriate for the sub-vector generation process.

25. A graphics display control system according to claim 20 further including a texture generator coupled to the output of said digital vector generator for controlling the on and off periods of a writing beam of said electronic display.

* * * * *